United States Patent [19]

Chauvel et al.

[11] Patent Number: 4,827,249

[45] Date of Patent: May 2, 1989

[54] VIDEO SYSTEM WITH COMBINED TEXT AND GRAPHICS FRAME MEMORY

[75] Inventors: Gerard Chauvel, Cagnes/Mer; Frederic Boutaud, Laurent-du-Var, both of France

[73] Assignee: Texas Instruments Incorporated, Dallas, Tex.

[21] Appl. No.: 82,965

[22] Filed: Aug. 5, 1987

Related U.S. Application Data

[63] Continuation of Ser. No. 746,594, Jun. 19, 1985, abandoned.

[30] Foreign Application Priority Data

Jun. 29, 1984 [FR] France ..... 84 0374

[51] Int. Cl.[4] ..... G09G 1/02

[52] U.S. Cl. ..... 340/703; 340/721; 340/747; 340/750; 340/799

[58] Field of Search ..... 340/701, 703, 721, 723, 340/744, 747, 750, 789, 799

[56] References Cited

U.S. PATENT DOCUMENTS

| | | | |
|---|---|---|---|
| 3,591,842 | 5/1986 | Clarke, Jr. et al. | 340/703 |
| 4,074,254 | 2/1978 | Belser et al. | 340/799 |
| 4,203,107 | 5/1980 | Lovercheck | 340/744 |
| 4,249,172 | 2/1981 | Watkins et al. | 340/799 |
| 4,308,532 | 12/1981 | Murphy | 340/723 |
| 4,543,645 | 9/1985 | Vigarié | 340/703 |
| 4,555,802 | 10/1985 | Fedak et al. | 340/703 |

*Primary Examiner*—Gerald L. Brigance
*Assistant Examiner*—Jeffery A. Brier
*Attorney, Agent, or Firm*—N. Rhys Merrett; Melvin Sharp; Gary Honeycutt

[57] ABSTRACT

This system includes a composite memory (5) in which are memorized the data for images to be displayed for each frame. A video display processor (12) controls the screen (8). A central processing unit (1) effects the composition of the image with the memory and an address processor (10), the extraction of the point data to be displayed being effected by a time base circuit (BT) synchronized with the sweeping of the screen, and by a control device (15) for dynamic access which distributes the access times among different units utilizing the memory. The memory (5) includes a first control memory for the memorization of a data word for a line or group of lines making up the image, each word having an address value for addressing a second control memory which contains, at each of these addresses, at least one display attribute data word characterizing the contents of the line(s) corresponding to the value of the respective address of the first control memory. A zone memory is provided for storing, in addressable zones, the text or graphics information for those lines which have intelligible information. For each of the lines having such information, a data word following the display attribute data word contains the initial address in the zone memory of the corresponding zone which contains the intelligible information to be displayed on the line.

17 Claims, 29 Drawing Sheets

VIDEO SYSTEM WITH COMBINED TEXT AND GRAPHICS FRAME MEMORY

This application is a continuation of application Ser. No. 746,594, filed June 19, 1985 now abandoned.

This application is related to application Ser. No. 746,422 and to application Ser. No. 746,595, both filed June 19, 1985 and both assigned to Texas Instruments Incorporated.

This invention relates to a display system for video images, displayed on a screen by line by line and point by point sweeping, the system being particularly useful for image display in data processing systems including video games, teletext networks, etc.

U.S. Pat. No. 4,620,289, issued Oct. 28, 1986 and assigned to Texas Instruments Incorporated by the instant applicant, describes such a system which includes a composite memory in which are memorized image data to be displayed for each frame, this memory being connected to a video display processor controlling the screen and to a central processing unit for composing the image in conjunction with the memory, the extraction from the memory of the data relating to the points to be displayed being effected under control of a time base means synchronized with the sweeping.

In this device, the composite memory includes a control memory in which are memorized the data words relating to the information to be displayed on each line of the screen, and a zone memory for memorizing the data relating to the intelligible information to be displayed in certain zones of the screen between one or more pairs of lines. The data to be displayed is assembled on the screen from the memorized data by coordination means which are part of the video display processor.

In such a device, the size of the composite memory can be considerably reduced, thereby diminishing the number of required integrated circuits.

An object of this invention is to provide an apparatus of the above type which reduces even further the amount of information which must be memorized for displaying images on a screen.

This invention therefore relates to a system for the display of video images on a display screen by line by line and point by point frame sweeping, this device including a composite memory in which are memorized image data to be displayed for each frame, this composite memory being connected to a video display processor controlling the screen, to a central processing unit, and to an address processor, for composing the image in conjunction with said memory, the extraction from the memory of the data relating to the points to be displayed being under control of a time base means, syncronized with the screen sweeping, and a control device for dynamic access to the memory for allocating the access times among different units of the system which utilize the memory, said composite memory including, on the one hand, a first control memory for memorizing a data word for a line or a group of lines making up the image to be displayed, each word containing data relating to this line and, on the other hand, a zone memory for the memorization of image data relating exclusively to zones of the image in which intelligible information is to be displayed, means being provided to coordinate, during display, the extraction of data from these two memories, this system being characterized in that, for the display of a frame, said first control memory contains an address value relating to each line of this frame, and in that said composite memory includes a second control memory addressable by address values contained in the first control memory and containing, at each of the addresses, at least one display attribute data word characterizing the contents of the line(s) corresponding to the value of the respective address of the first control memory.

The invention will be more fully described in the description which follows.

FIG. 1 is a general schematic of the display system according to the invention.

FIGS. 2*a* and 2*b* are a more detailed schematic of the display system of FIG. 1.

Figure 1:
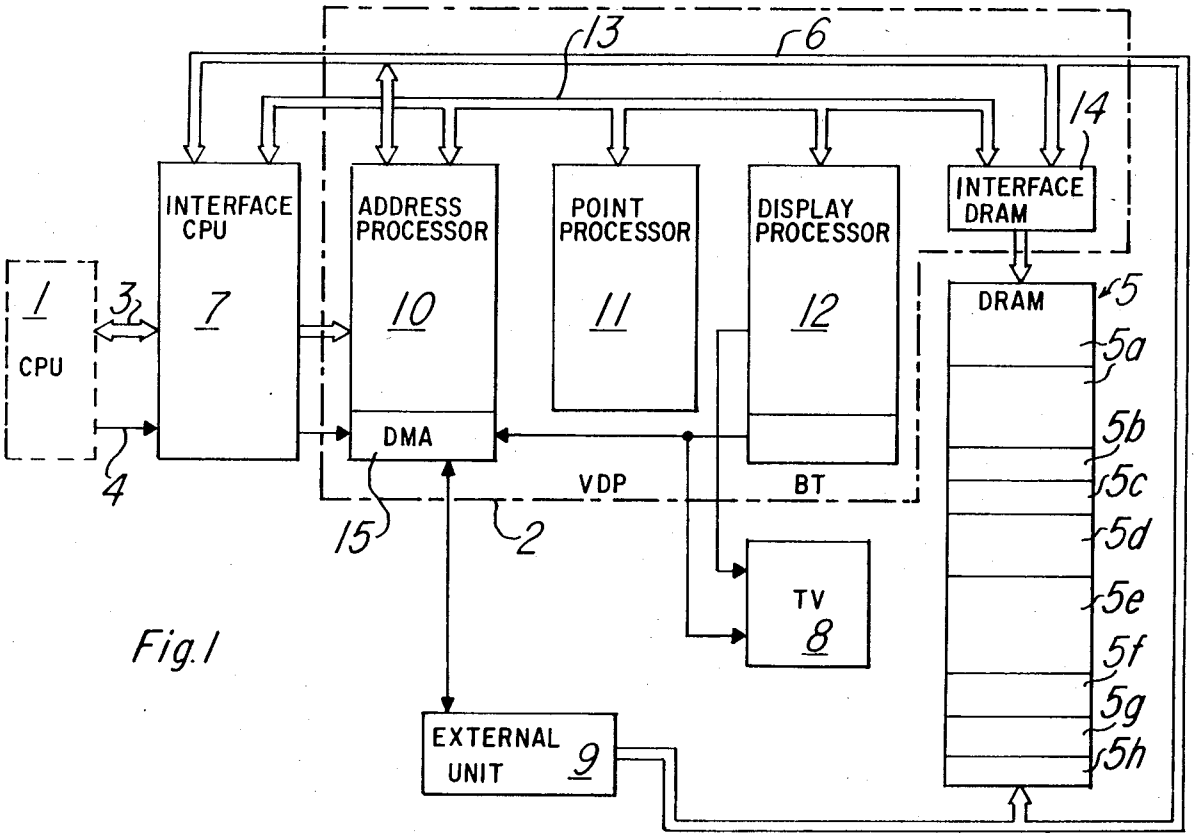
FIG. 1 shows a very simplified schematic of the visualization system in which the invention is used. This system includes a plurality of units as follows.

A central processing unit 1, CPU, which controls all the operations of the system by means of a program stored in the CPU's memory.

A video display processor 2, VDP, which communicates with the CPU by bus 3 and control line 4, the address and data information circulation on bus 3 being time multiplexed according to the process described in the portions of copending application Ser. No. 583,072, filed Feb. 23, 1984, discussing FIGS. 1 through 11*b* therein, by the instant applicant.

A dynamic random access memory 5, DRAM, which communicates with the other units of the system by bus 6 in time sharing, this bus being connected to CPU 1 over interface 7.

A display unit 8 which can be a conventional television or a conventional monitor, this unit being adapted to display the visual information processed in the system according to the invention by means of, for example, a cathode ray tube.

An external unit 9, or didon, by means of which the inventive system communicates with an external information source which might be, for example, a teletext emitter connected to the system by, for example, a radio transmitted television channel, or by a telephone line, or otherwise. The external unit 9 loads the information into memory 5 to effect, after processing in the system, the display of the information on the screen of display unit 8.

The video display processor includes an address processor 10, a point processor 11 for operating on the points of the screen of unit 8, for obtaining, for example, changes in the form of the image, and a display processor 12, these units communicating with each other over time sharing bus 6 and bus 13, on which only data can circulate.

Buses 6 and 13 are connected to DRAM memory 5 over interface 14 which multiplexes the data and addresses destined for DRAM 5.

There is also provided a control unit 15 with dynamic access to DRAM memory 5. This unit is described in detail in U.S. Pat. No. 4,623,986, issued Nov. 11, 1986, to the assignee of the instant application, and this unit will be referred to, hereinafter, as DMA circuit 15. In addition, there is provided a time base circuit BT associated with the display processor and communicating with DMA 15, television monitor 8, and the display processor itself.

It has already been indicated above that CPU 1 communicates with VDP 2 by a single multiplex bus 3 which carries information under control of the signals themselves transmitted on line 4 in such a way that the addresses which are transmitted over this bus can be used, on the one hand, as addresses for DRAM memory 5 when CPU 1 communicates directly with this memory, and by means of which the consecutive data field is utilized to read or write in the memory, or, on the other hand, as an instruction field placing VDP 2 into a particular configuration for processing the data contained in the consecutive data field.

More specifically, in the said the portions of application Ser. No. 583,072 discussing FIGS. 1 through 11*b* therein, the information which passes over bus 3 each have two information fields, the first, enabled by signal AL (address latch), transports either an address for the direct accessing of DRAM 5 or an instruction which is adapted to be interpreted by VDP 2. The second field enabled by the signal EN (enable) contains data which traverses the bus in one of two directions, the direction being determined by signal RW (read/write). With the first field, (address for the memory or interpreted instructions), the data can be sent to the memory or can come from it, or can be utilized by VDP 2 placing it in one of its two processing configurations, referring to FIG. 3.

DRAM 5, in the system here described, is a composite memory having a plurality of zones, addressed starting from a base address. This memory is composed of at least a page memory 5*a*, memories for the control of lines and columns 5*b* and 5*c* (see, in this regard, the patent applicaion), at least one zone memory 5*d*, at least one form memory 5*e*, typographic character memories 5*f*, a buffer memory 5*g*, which adapts the various processing speeds to each other, in particular, that of central processing unit 1 and external channel 9 (see, in this regard, EP-A-No. 00 054 490), and, optionally, a memory 5*h* programmed in assembly language, for CPU 1, etc.. All of these memory zones can be accessed by the internal units of VDP 2 and by CPU 1, these accesses being controlled either by the CPU 1 itself of by the device or dynamic access to memory 15 (see, in this regard, said U.S. Pat. No. 4,620,289). In order more easily to understand following description, it is useful briefly to review the operation of DMA circuit 15.

This circuit distributes access times to DRAM 5 depending upon the priority of the users of the system, that is, CPU 1 and the various units of VDP 2. DMA circuit 15 can be requested by each of these users to access the memory, either in a single cycle (monocycle) or in a series of consecutive accesses (multicycle). In this latter case, DMA 15 can control a particular number of accesses to the memory by column access signal (CAS), while utilizing only a single row access signal (RAS). This is particularly useful, for example, when this system prepares the display of an entire page on the screen, and it is necessary to access a very large number of memory positions, which are contiguous, and in regard to which, it is only necessary to increment the column address each time by a single unit, with the row address remaining the same for all accesses of this row. It is to be noted that all access procedures of memory 5 are determined by DMA circuit 15.

Figure 2A:
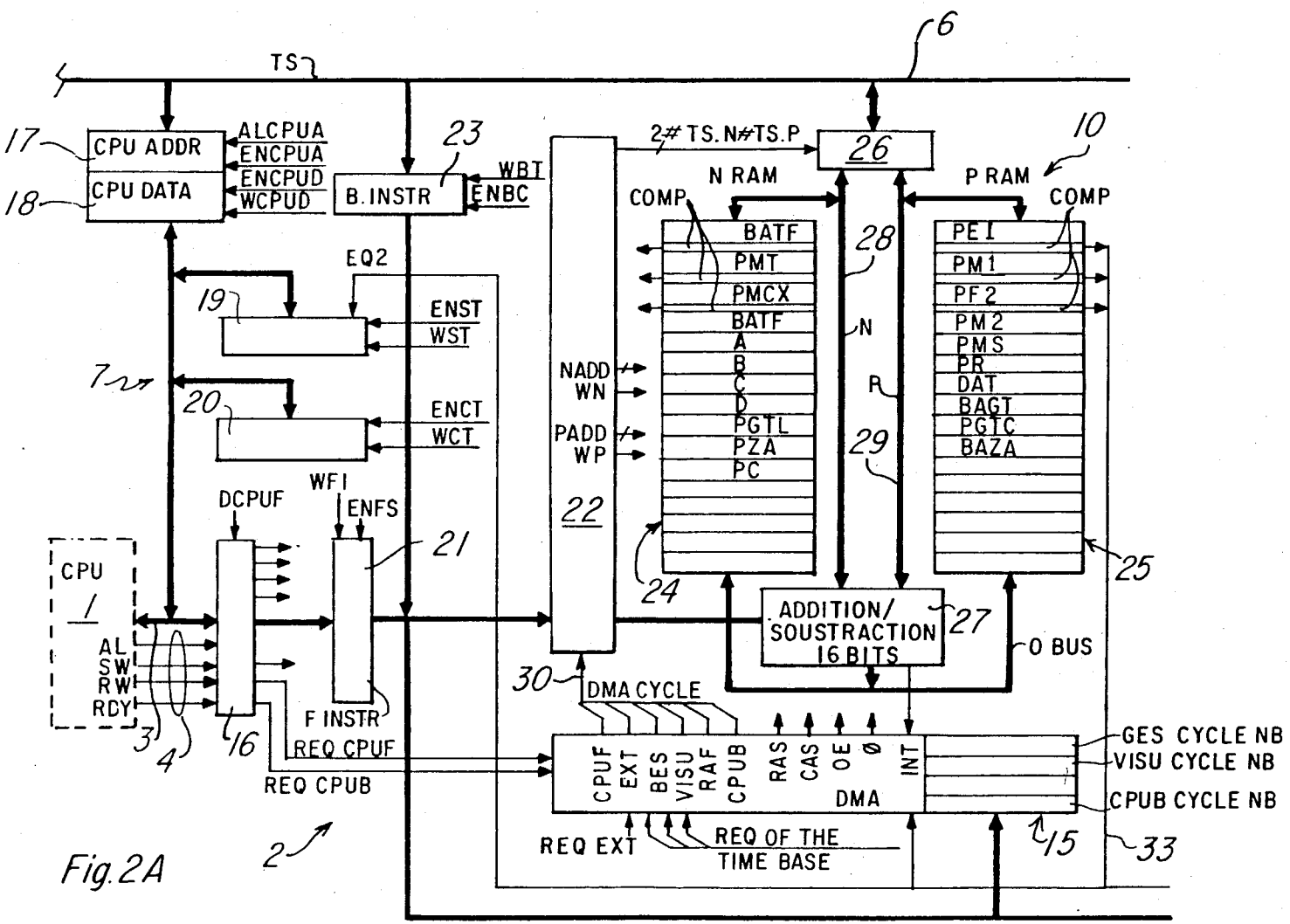
Figure 2B:
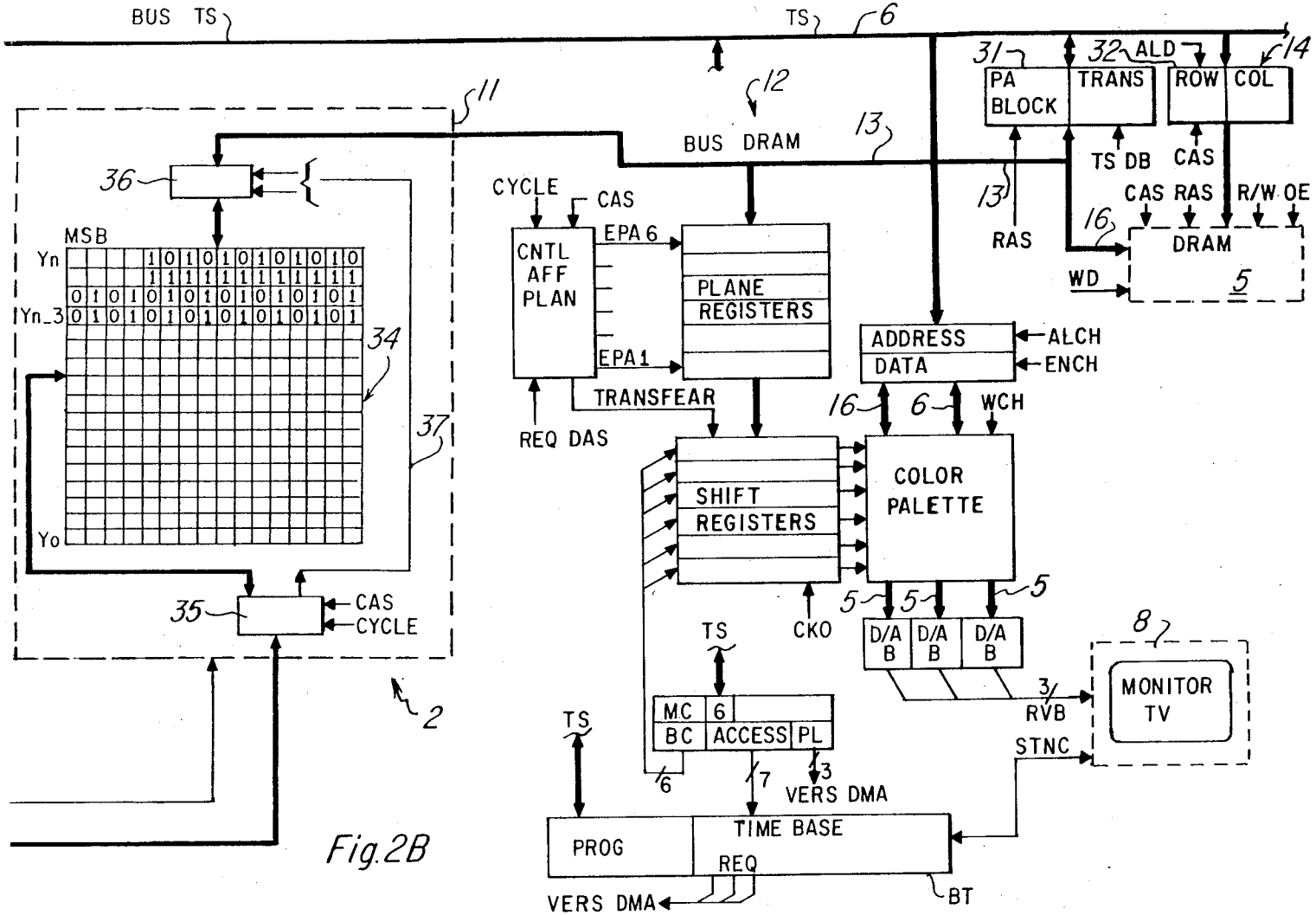
Figure 3:
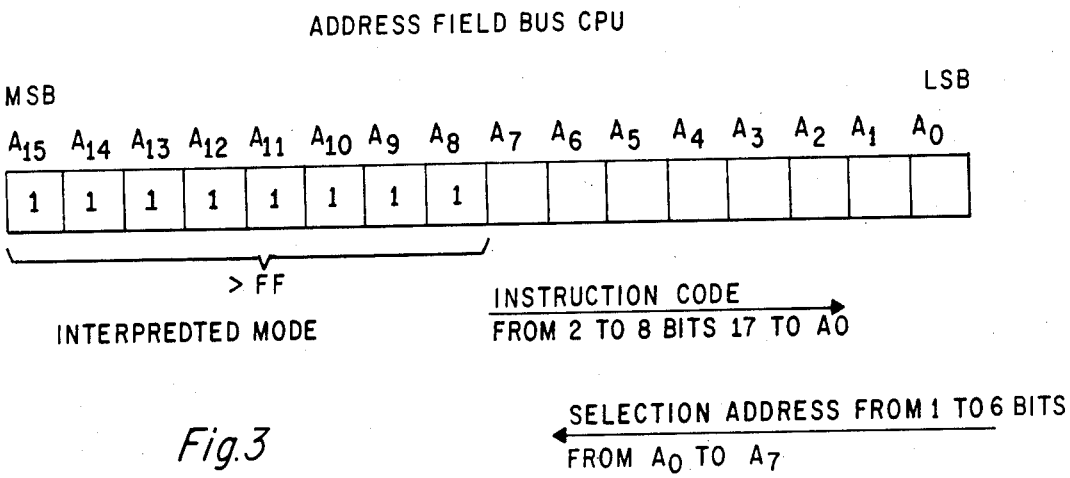
FIG. 3 represents an address field in transit over the bus connecting the central processing unit of the system to the video display processor.

There will now be examined in more detail the schematics seen in FIGS. 2*a* and 2*b*.

Interface 7 selectively connects CPU 1 to VDP 2 for indirect accessing, or to DRAM 5 for direct accessing. It is capable of interpreting each address field.

The interface 7 includes decoder 16 connected to bus 3 and including 16 outputs, four of which, those corresponding to the two least significant bits, are used to enable four registers of the interface. These registers are:

address transfer register 17 enabled by ENCPUA;
data transfer register 18 enabled by signal ENCPUD;
state register 19 (STATUS) enabled by ENST;
control register 20 enabled by ENCT;

These four registers are controlled for reading and writing by signal R/W (for writing R/W=0) which is applied to their corresponding control inputs.

The other instructions resulting fom an interpreted address, which are 256−4=252 in number, with the least significant 8 bits of the address field (FIG. 3), are adapted to execute foreground cycles by register FG 21 which is a part of interface 7 and which is connected between certain outputs of decoder 16 and address processor 10 and to the address inputs of read only memory CROM 22 which is a part of this processor.

Register 23 of interface 7, called a background register, is loaded with instructions BG when it is designated by an address field, the interpretation of which calls upon one or several background BG cycles. A detailed describtion of the operation of interface 7 and the interpretation of instructions FG and BG is in patent application Ser. No. 746,422, filed June 19, 1985 and assigned to Texas Instruments Incorporated.

The address processor, besides memory CROM 22, includes two register stacks 24 and 25 called NRAM and PRAM which are loaded and read in 16 bits via transfer register 26 connected to time sharing bus 6. Each stack is connected to arithmetic and logic unit ALU 27, which is itself connected directly to bus 6 by transfer register 26 and to two 16 bit buses 28 and 29, N and P. The address processor is used principally to provide and calculate all of the address generated by the VDP for accessing memory 5.

Memory 22, when it is addressed by a part of the instruction contained either in register 21 FG or in register 23 BG, selects a microinstruction here stored to enable one or more registers of stacks 24 and 25, an arithmetic or logical operation in ALU 27, and transfer by register 26. The operations of ALU 27 are controlled by five bits of the microinstructions which can select the remainder Cl=0, 1, or 2) and an addition or subtraction operation on bus P or N, 28,29, or between these two buses.

Control memory CROM 22 also provides the signals for the controlling the other units of VDP 2 for the transfer of data and addresses between the various buses and registers. The microinstructions addressed in CROM 22 are each time enabled in time sharing by DMA 15 on line 30 for establishing a relative priority order for memory accessing. In the case here discussed, six priorities are established in the order:

1. CPU-FG
2. External path (didon 9)
3. Display control
4. Display (display processor 16)
5. Reload memory 5
6. CPU BG.

From the above it is seen that the foreground cycle FG is used by CPU 1 for direct access to the memory or to access the internal registers of VDP 2, and this for exchanging, with the memory, only a single 16 bit word at a time.

Background cycle BG is executed with a lower priority, that is, when VDP 2 does not have other cycles to execute for other users. The BG cycle is started either by the CPU by cycle FG, or by VDP 2. When it is the CPU which starts such a cycle or group of cycles, there can be, for example, a displacement of a group of words in memory 5, this operation being executed without the CPU intervening again after the cycle FG, so that the CPU can continue to process FG during the execution of the BG cycles, all of this being controlled by DMA 15 in the established priority (in this case there will be an interruption and then a restarting of the execution of the BG cycles).

The considerable advantage of this arrangement is that various users of the memory can work and communicate at their own speed, without being interferred with by other users, the DM effecting the appropriate priority in all cases.

Interface 14 of DRAM 5 includes two transfer registers 31 and 32 controlled by the signals provided by the microinstructions of memory CROM 22 and by signals RAS and CAS from circuit DMA 15 to transfer the data and address fields of bus 6 to the DRAM or vice versa. The data can also be transferred directly into memory 5 from bus 13 to addresses transferred over bus 6 and register 32 from address processor 10.

The point processor 11 includes a 16 word, 16 bit, RAM memory 34, the rows being addressable by addresses YO to YN. It will be appreciated, however, that the point processor could have a much more complex structure to allow veritable manipulations of image elements. In such a case, there could be used the processor described in the patent application filed June 19, 1985, Ser. No. 746,595 and assigned to Texas Instruments Incorporated.

The point processor 11 also includes address register 35 which can be advance loaded from BG register 23 which down counts its contents by means of signal CAS. This register also controls transfer register 36 by line 37 to transfer the contents of the addresses of RAM 34 on bus 13 when required.

The display processor (the detailed description of which will follow), includes a set 38 of three digital-/analog convertors for converting the five bit time signals (channel RVB) into intensity levels which are used for controlling monitor 8. Thirty-two color levels can be obtained in the example here described.

The converters 38 are connected to reading outputs of memory 39, called a "color palette", the contents of which being modified in a dynamic manner by CPU 1 as a function of the CPU program. In this regard, memory 39 is loaded from data and address registers 40 and 41 connected to time sharing bus 6.

RAM memory 39 is addressed by a group 42 of shift registers, the outputs of which being connected to this memory, and the inputs of which, clock CKD (shift rate) being connected to time base BT. Normally, the shifting frequency is equal to the frequency with which the points are displayed on the screen.

Shift registers 42 can be loaded in two manners, namely, by register group 43, called "plane registers", and by register 44, called a "base color register" forming a part of unit 45 for attribute storage. Plane registers 43 are loaded from point processor 11 or from DRAM memory 5 by bus 13, and unit 45 is loaded by bus 6, for example, from memory 5 or from CPU 1.

The operating principle of the display processor is described in FR No. 83 06 741 as to image display by a control memory in which the composition data for each line to be displayed are stored.

There will be reviewed the display method which saves a considerable amount of memory capacity in comparison with that necessary if there must be stored in advance of the display the distinct data of each triplet RGB of image points in the page memory.

Figure 4A:
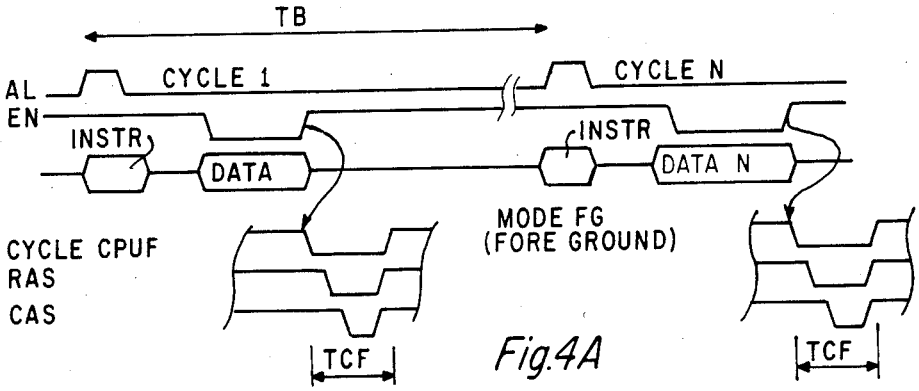
FIG. 4 is one possible organization for the system memory for the display of graphical information.
Figure 4B:
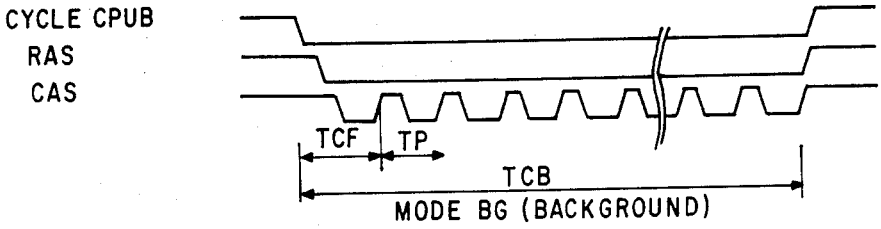

FIG. 4 is a diagram illustrating the utilization of memory planes. This is an abstract concept which allows the illustration of the manner in which the image points are memorized in the page memory.

Each plane represents a complete visual zone of this screen and is composed of memory cells, one for each image point of the screen. The cells are a part of DRAM 5 and can be physically distributed in any manner in the memory network, provided the addresses are known.

One can represent the color of a point by "superposition" of cells C1 to CN having the same coordinates in the memory planes.

If there is extracted the contents of the cells at the same coordinates of the memory planes, there is obtained a binary color code which serves as the address of palette memory 39, the address corresponding to a word of 15 bits (in the example under consideration here), distributed in five bit groups, applied to digital-/analog converters 38.

The number of planes used can vary during the display. Assume, for example, that the image is composed of only two colors; in this case, a single memory plane suffices for the first color with "one" bits, and the other color with "zero" bits. This system thus can define each point from a set of colors, the number of colors being 2 to the n-th power, n being the number of memory planes. In the example, n=6 so that one can display two to the 6-th=64 different colors for each point of the screen.

The memory planes thus defined are associated with a background plane defining the color of the image background.

This color will appear automatically in the viewable zone. It is coded by an entire frame to be displayed in register 44, the contents of which progress at the rate of the point clock in shift registers 42, unless these are loaded with the contents of plane registers 43 when different background information is to be displayed. It is to be noted that, as the example is a 16 bit system, the extraction from the memory of the color information is effected in 16 bits for 16 image points at a time. It is to be noted also that the contents of the palette memory can vary during operation so that each address code which is applied to the memory does not always correspond to the same color which is actually displayed.

Figure 5:
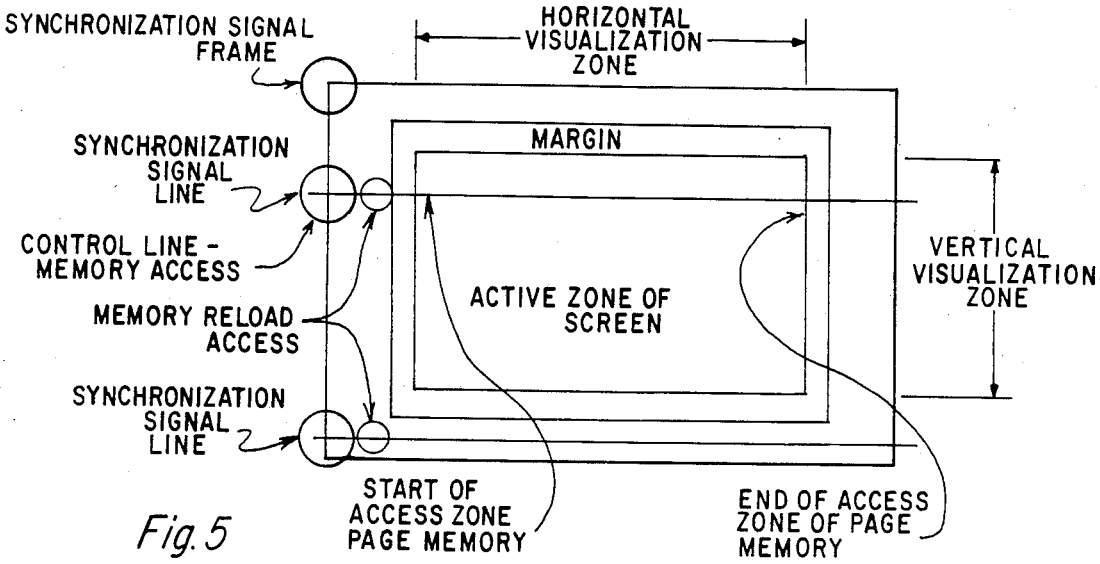
FIG. 5 is a diagram illustrating the principal zones of the screen and their significant time periods during the display of a frame.

FIG. 5 is a diagram of a video frame on which are inscribed the various operations to be executed for display. It is the time base circuit BT which, from the frame and line syncronization signals, processes all of the required time signals.

The frame is composed of three concentric zones, that is, the viewable zone at the center, a margin zone, and an exterior compensation zone which for adapting the image definition to all of the known types of monitors and display apparatus.

The color of the margin zone is defined for each frame in margin register 46 (FIG. 2*b*) which is enabled only during the display periods of each line corresponding to the margin zone.

To extract the information to be displayed from DRAM memory 5, the system utilizes various pointers which form a part of stacks 24 and 25 of address processor 10.

Figure 6:
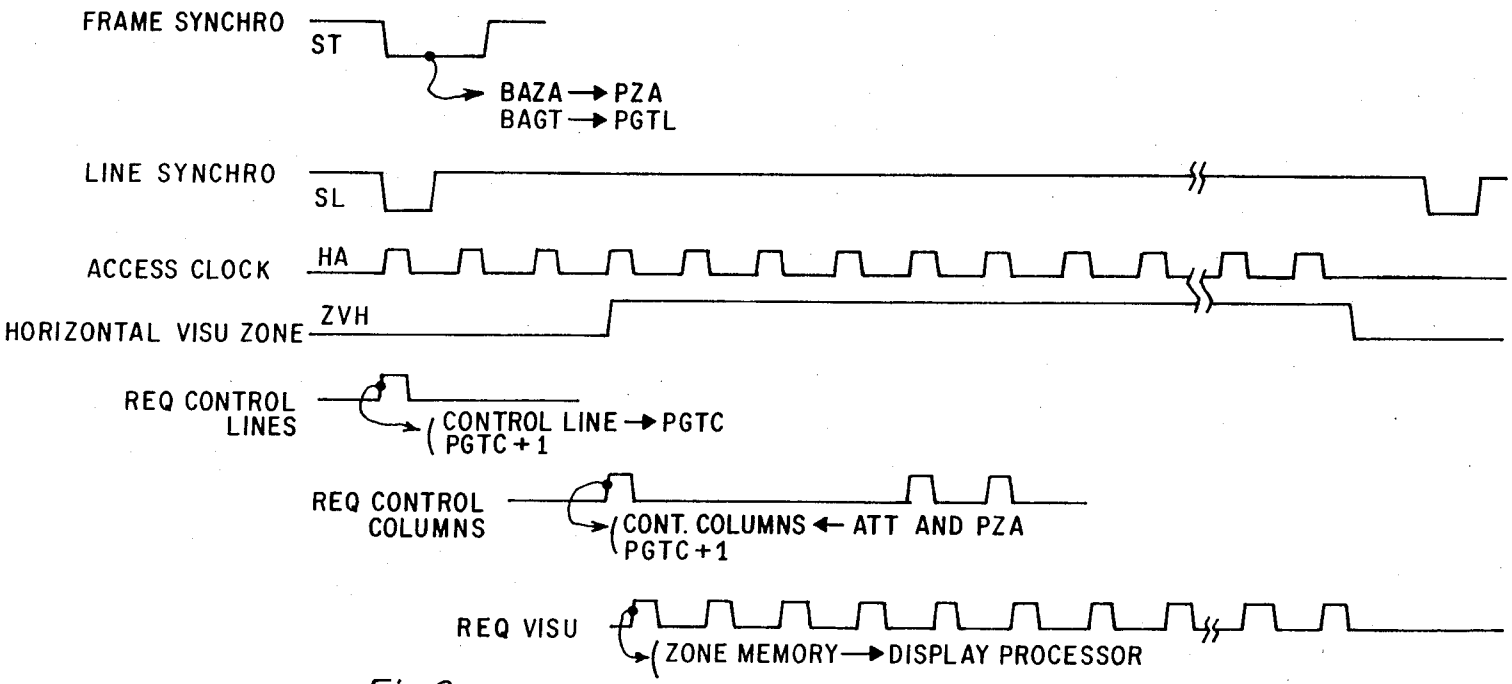
FIG. 6 shows the signals produced by the system time base means for the display of a frame.

FIG. 6 is a time diagram of the signals generated by time base circuit BT which effect all of the system display modes.

The first display mode is called "full page", and consists of memorizing, in DRAM memory 5, all the display information relating to a frame to be displayed, and reading successively, at the corresponding addresses, the point data in one or more color planes. In this mode, the display characteristics do not change during frame display.

Before display, the attribute data are memorized in attribute storage unit 45 by corresponding CPU cycles so that this unit will contain the code of the margin color, a base address for addressing the palette memory 39, a number of color planes for the display, and a background color code for the viewable zone.

Figure 7:
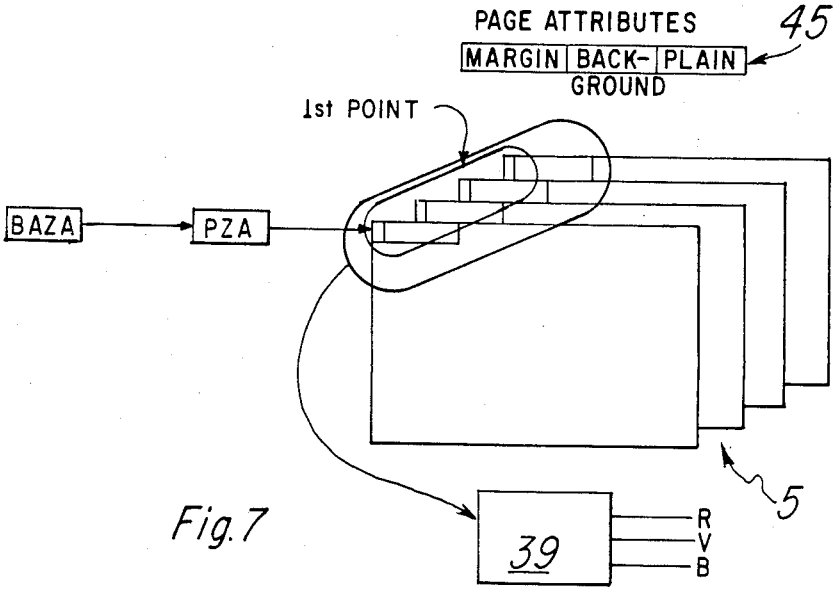
FIG. 7 illustrates the display method when the color information for all the points of the screen are integrally memorized in the page memory of the system (full page mode).

When the frame synchronization pulse appears, the base address BAZA of the memory zone in which the page is memorized is transferred to pointer PZA in stack 24 (FIG. 7). During the active zone of the screen, each access request REQVISU formed by time base circuit BT and processed by DMA circuit 15 (see FR No. 83 03 143 for more details), extracts, at the current address PZA, a number of words corresponding to the number of planes programmed into unit 45. With the 16 bit format of the example, each request for access REQVISU corresponds to a group of 16 points of the screen. For example, in the present case, as the number of planes selected is 4, each access request extracts four words of 16 bits from the memory. Each point of the screen is therefore defined by four bits, which, by means of registers 42 and 43, are applied as an address to palette memory 39 at the rate of the point clock for selecting one color among 16. The address processor 10 increments pointer PZA upon the extraction of each word from the memory.

It will be appreciated that this display mode uses a great deal of memory as each image point is described in a number of bits equal to the number of memory planes selected (for 6 memory planes, there would be required 60K bytes).

Usually, in a page to be displayed, numerous points have common characteristics. For example, large zones of the image might be a uniform color and serve to frame other zones where intelligible information is to appear.

Consequently, one can often considerably reduce the memory needed for the display of a frame by using a portion of the DRAM memory as a control memory and by associating this control memory with another portion forming a zone memory. The zone memory is therefore loaded in the manner of the page memory, as previously described, with information regarding all the points of only an image zone, all of the other portions of the zone being memorized in the form of words which themselves contain the information regarding all the image points of one or more lines (see FR No. 83 06 741).

According to the invention, a part of DRAM memory 5 is organized as a control memory including a first portion in which are stored the words for each frame line, and a second portion in which are stored the data relating to the column parts of the image. This control memory is also associated with a zone memory for the intelligible information.

Figure 8:
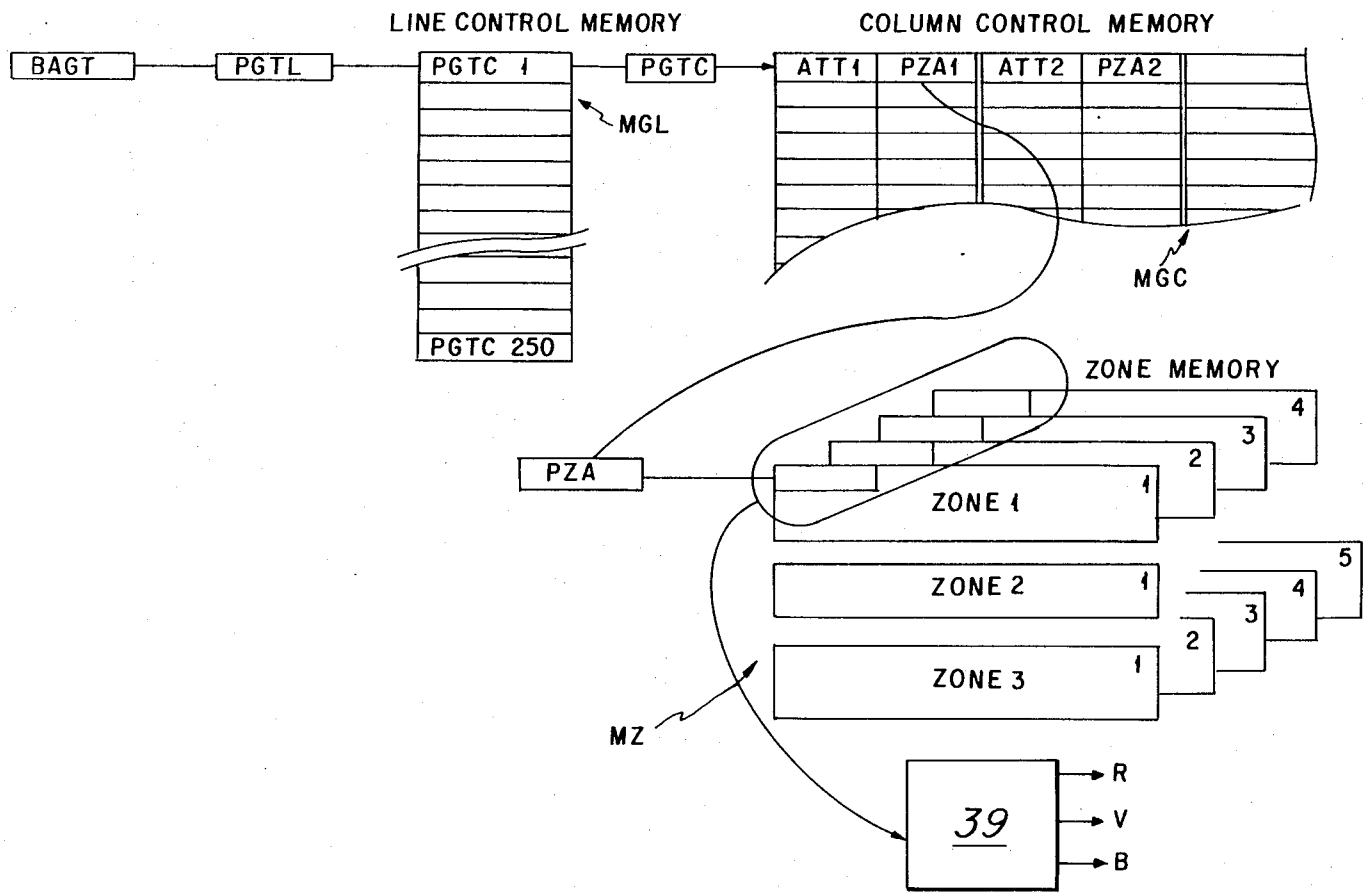
FIG. 8 illustrates the display method using zone attributes.

FIG. 8 is a diagram illustrating this display mode called "Graphic Mode by Zone Attributes".

In this display mode, there are utilized a line control memory MGL, a column control memory MGC, and a zone memory MZ. In this latter memory, the intelligible information of the image are memorized along with one or more color planes.

The line control memory MGL has as its function the assembling of the parts of column control memory MGC, this latter assembling the partial pages memories which make up zone memories MZ. The circuit of FIGS. 2*a* and 2*b* reconstitutes, from the contents of these memories, the frame under consideration at the moment when the frame appears on the screen.

The data contained in column control memory MGC includes the attributes to be loaded into storage unit 45 and, if necessary, a zone address PZA which designates the zone to be placed at the corresponding location in the image. The attribute data contains the base address of the palette memory, the number of color planes, and the number of accesses to be effected to display the zone.

The line control memory MGL is successively read for each line during a line syncronization signal. This memory includes, for example, 250 words of 16 bits each.

Figure 9:
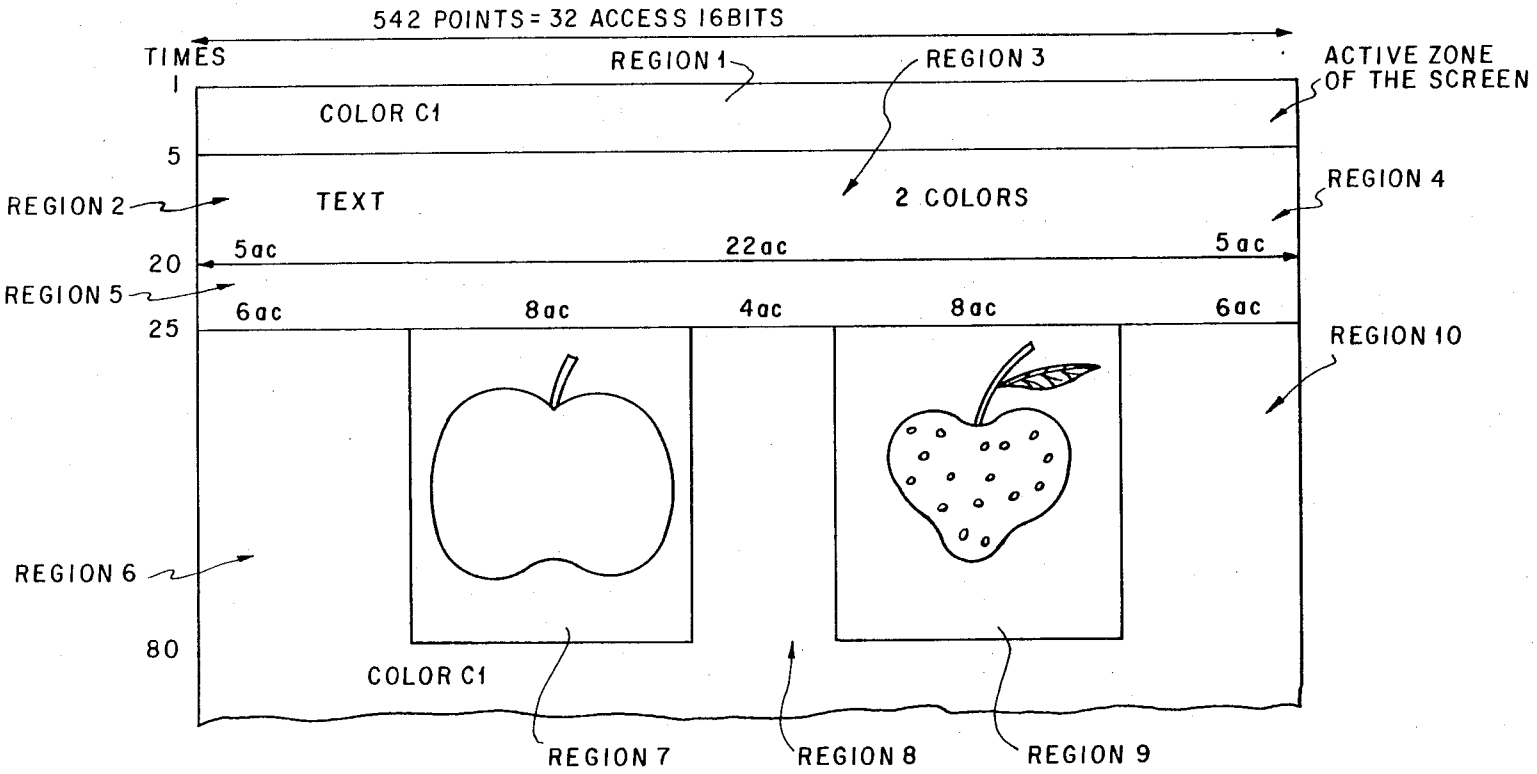
FIG. 9 illustrates the display of an image frame on the screen.
Figure 10:
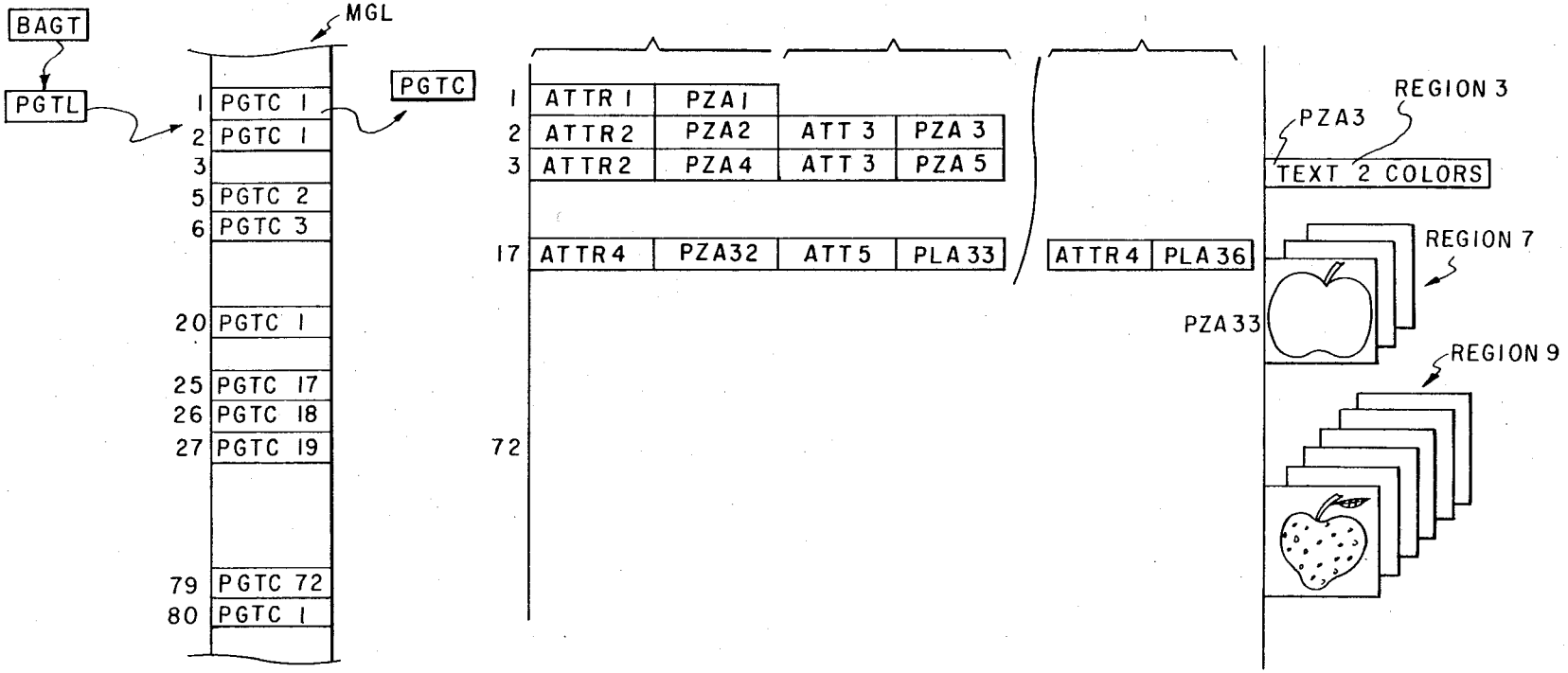
FIG. 10 represents a portion of the contents of the memory when the image of FIG. 9 is displayed.
Figure 11:
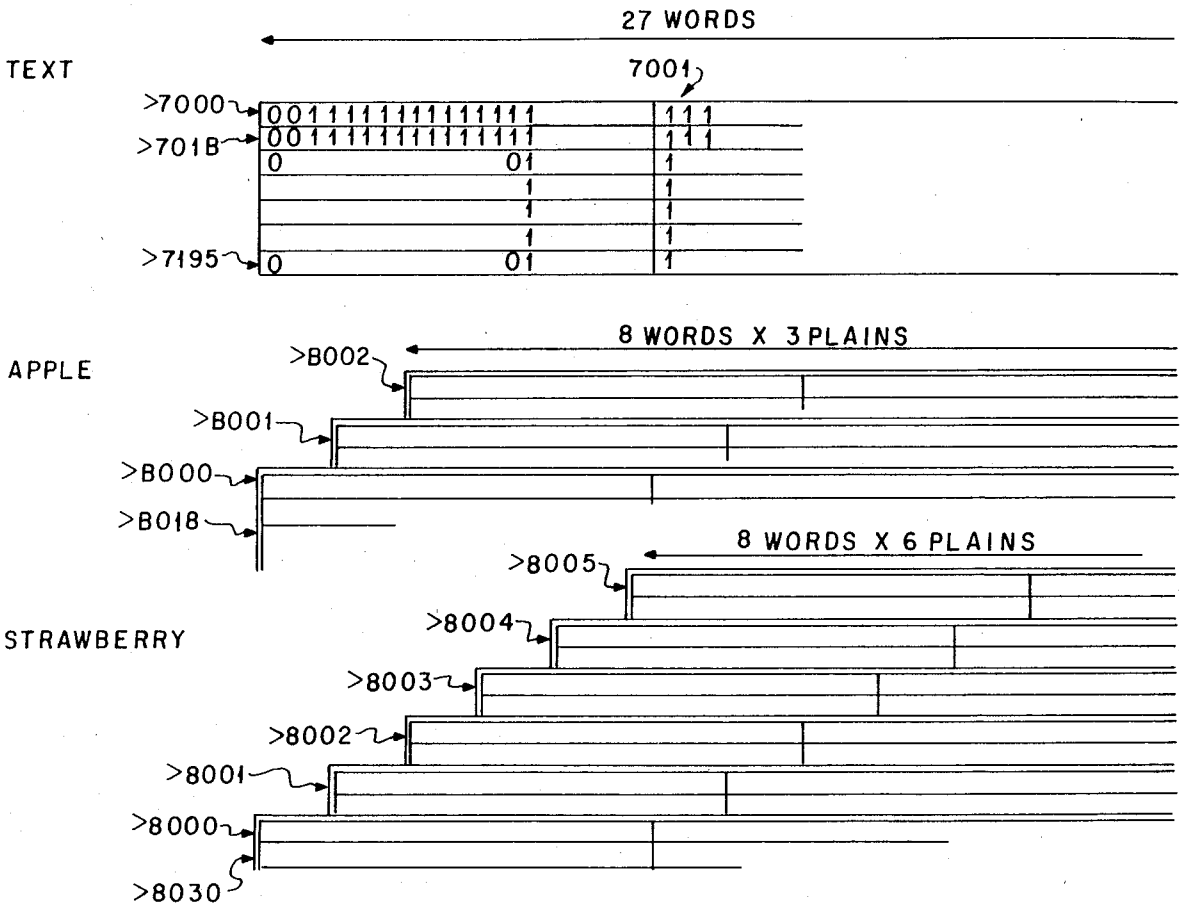
FIG. 11 is a more detailed representation of the contents of the zone memory of FIG. 10.

The number of accesses memorized among the attribute data in memory MGC is loaded into the access counter forming a part of unit 45. FIGS. 9 and 10 illustrate an example of the display of an image on the screen in a graphic display mode by zone attributes. The example has eighty lines of the screen representing respectively:

Lines 1 to 4—region of uniform color C1;

Lines 5 to 20—three regions 2 to 4 with a uniform background color (regions 2 and 4) and a text set forth in two colors (region 3);

Lines 20 to 25—a region 5 of uniform color C1;

Lines 25 to 80—a region 6 of uniform color, a region 7 representing an apple defined in eight colors, a region 8 of uniform color, a region 9 representing a strawberry defined in 64 colors and a region 10 of another uniform color.

Starting from line eighty, it is assumed that the image has a region having a uniform background color. The image margin is not shown in FIG. 9.

In FIG. 10, only regions 3, 7, and 9 are defined in the system memory with particular color information for each image point. Region 3 is defined on a single color plane, region 7 on three planes (3 bit code=8 colors), and region 9 on 6 planes.

The line control memory MGL contains, for each line, an address pointing to an address of column control memory MGC.

At each of the addresses of this memory are memorized the attributes of the image region in question. If the next line to be displayed has the same contents, the value at the location of the line control memory corresponding to this line is the same as that of the preceding line, and the same attributes are therefore utilized. Thus, region 1 of the screen of FIG. 9 corresponding to the four first lines are displayed with the address values pointed by PGTC1. As the region 1 is constituted by a single color, only the attribute word is utilized, the value PZA1 which should correspond to the base address of a zone of the zone memory is not utilized.

The attribute ATTR1 defines in 16 bits the base color C1 of palette memory 39, the number of color planes (here equal to zero), the number of accesses (here 32 for 512 image points per line).

To display a background line, there is only needed the pointer value (PGTC1), the attribute ATTR1, and the zone address which is three words of sixteen bits. The use of the zone base address word (PZA1) will be explained hereinafter. For the four first lines of the screen, there is required therefore a total of six words of sixteen bits, while in a full page display mode, there are required 32 accesses×6 planes×4 lines=768 words.

At the start of the fifth line on the screen, the value PGTC2 points to the second line of the column control memory MGC in which the attribute ATTR2 defines the characteristics of region 2. This attribute contains the base color information (C1), the number of planes (0), the number of accesses (5), and the address PZA2 (not utilized) associated with it. After five accesses (80 image points), the pointer PGTC extracts ATTR3 and PZA3, which defines, for region 3, the base color (C2), the number of memory planes (1), the number of accesses (22), and the address of the zone memory MZ where the image data to be displayed are stored. The base address of this part of the zone memory is PZA3, and this value is successively incremented for the 22 following accesses for extracting data from the zone memory. In region 4, the line is again displayed in a single color C1.

Regions 2 to 4 are also presented line by line until line 19, after which region 5 is processed in the same manner as region 1.

Regions 6 to 10 require, for each line, accesses to the column control memory MGC for the display of the apple and strawberry in a plurality of colors.

From line 80, the screen is composed similar to regions 1 and 5.

If the image of FIG. 9 is to be displayed in the full page mode (a screen with 512 points per line with 512 lines), there would be required a page memory of 98K words of 16 bits with 32 accesses per line. In such conditions, 16K words would be required to describe a memory plane.

If, on the other hand, there is utilized the method according to the invention, there would be required:

| | | |
|---|---|---|
| For region 2: 22 × 15 = | 330 | words |
| For region 7: 8 × 55 × 3 = | 1320 | words. |
| For region 9: 8 × 55 × 6 = | 2640 | words. |
| Memory MGL: 512 lines = | 512 | words. |
| Memory MGC: address 1 = | 2 | words. |
| addresses 2 to 16 = | 60 | words. |
| addresses 17 to 72 = | 550 | words |
| Total: | 5414 | words. |

It is noted that the memory size is relatively very small for an image containing a certain quantity of intelligible information. Of course, this memory size will increase if the intelligible information is increases, but, in most of image sequences, it is rare that this information will extend over more than 50% of the screen.

There will now be described in more detail the principal display phases of the image of FIG. 9.

The starting addresses of the different memory zones are: (FIGS. 11 and 12) (It is to be noted that the values are selected only as examples).

>0000 for the line control memory MGL.

>0200 for the column controlled memory MGC.

>7000 for the text (defined on a plane to obtain two colors),

>B000 for the apple (defined in three planes to obtain eight colors),

>8000 for the strawberry (defined on six planes to obtain sixty-four colors).

The initialization phase of the frame display consists in preparing the contents of the different parts of the DRAM memory controlling display and the VDP2 for the display, namely:

loading the base address "BAGT"

programming the parameters of the time base circuit BT, loading the palette memory 39, selecting the graphical operation mode by zone attributes.

The parts of the zone memory "text", "apple", and "strawberry" are loaded by CPU1 (FIG. 2*a*). Each line of "text" includes 27 accesses defined on a plane and requires 27 words of 16 bits. The "0" and "1" bits which define the form are programmed from line >7000. The second line is situated at >address >701B (27 decimal=1B hexadecimal). The address of the start of the last line is >7195.

The "apple" is defined on three planes in eight colors. Each line of this zone includes eight accesses, that is, 24 words. The contents of the planes read during the first access of this zone is situated at addresses >B000, >B001, >B002. The address of the beginning of the following line is>B018.

The "strawberry" is defined on 6 planes in 64 colors, each line of this zone including eight accesses, that is, 48 words. During the first access, the contents of addresses >8000 through >8005 are read and then transferred to display processor 12. The address of the start of the following line is >8030 the address of the start of line 40 is >9008.

Figure 12:
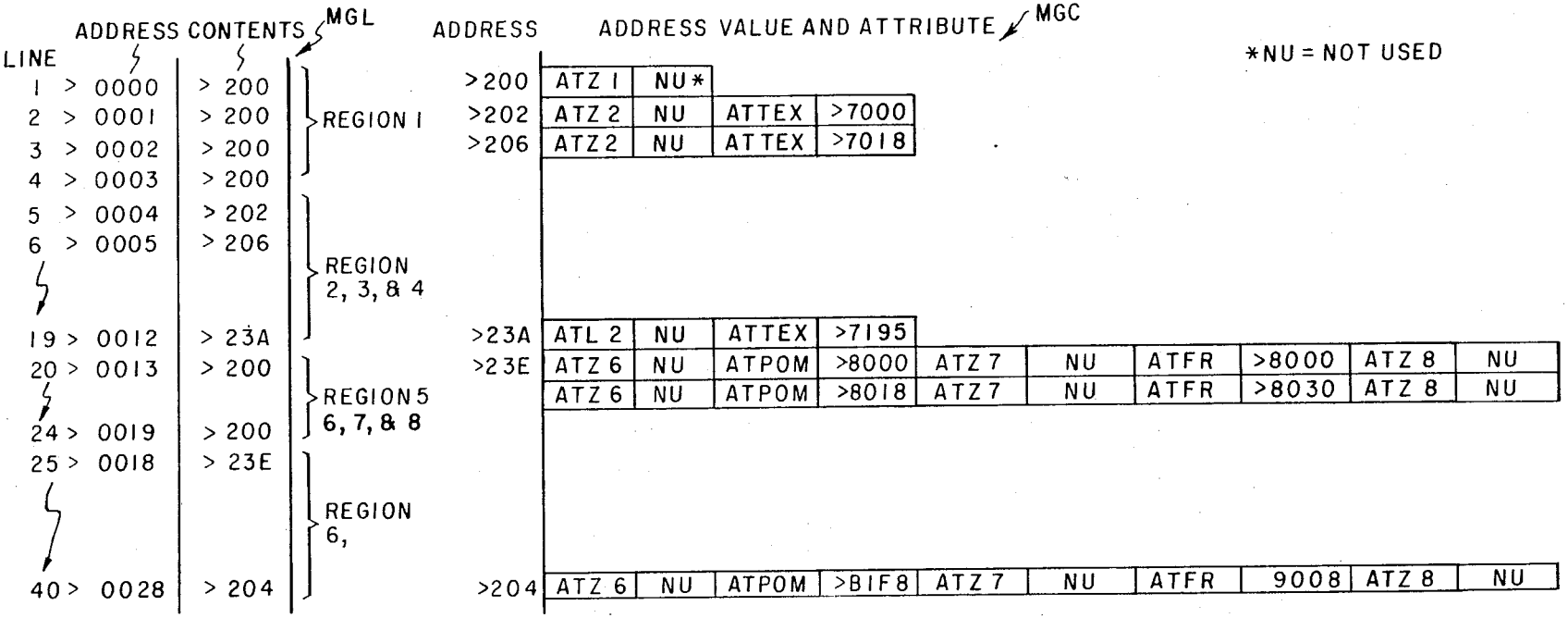
FIG. 12 shows in detail the address label when the FIG. 9 frame is to be displayed.

FIG. 12 shows that the line control memory MGL selects, according to its contents, the column control zones where are defined the attributes ATTR and the addresses PZA corresponding to the description of the line to be displayed. The zones are more or less wide depending upon the display. For example, the four first lines of the screen are defined by the sole attribute "ATZ1" memorized at address >200, lines 25 to 80 require 5 attribute memorizations for the different zones. For each line to be displayed, there will be found in the column control memory the addresses of the lines of displayed zones.

The display process of the frame is initialized by address "BAGT"=0000 of the start of the line control memory. The 64 emplacements of palette 39 are loaded by color corresponding to the codes memorized in the memory of the display zones.

Figure 13:
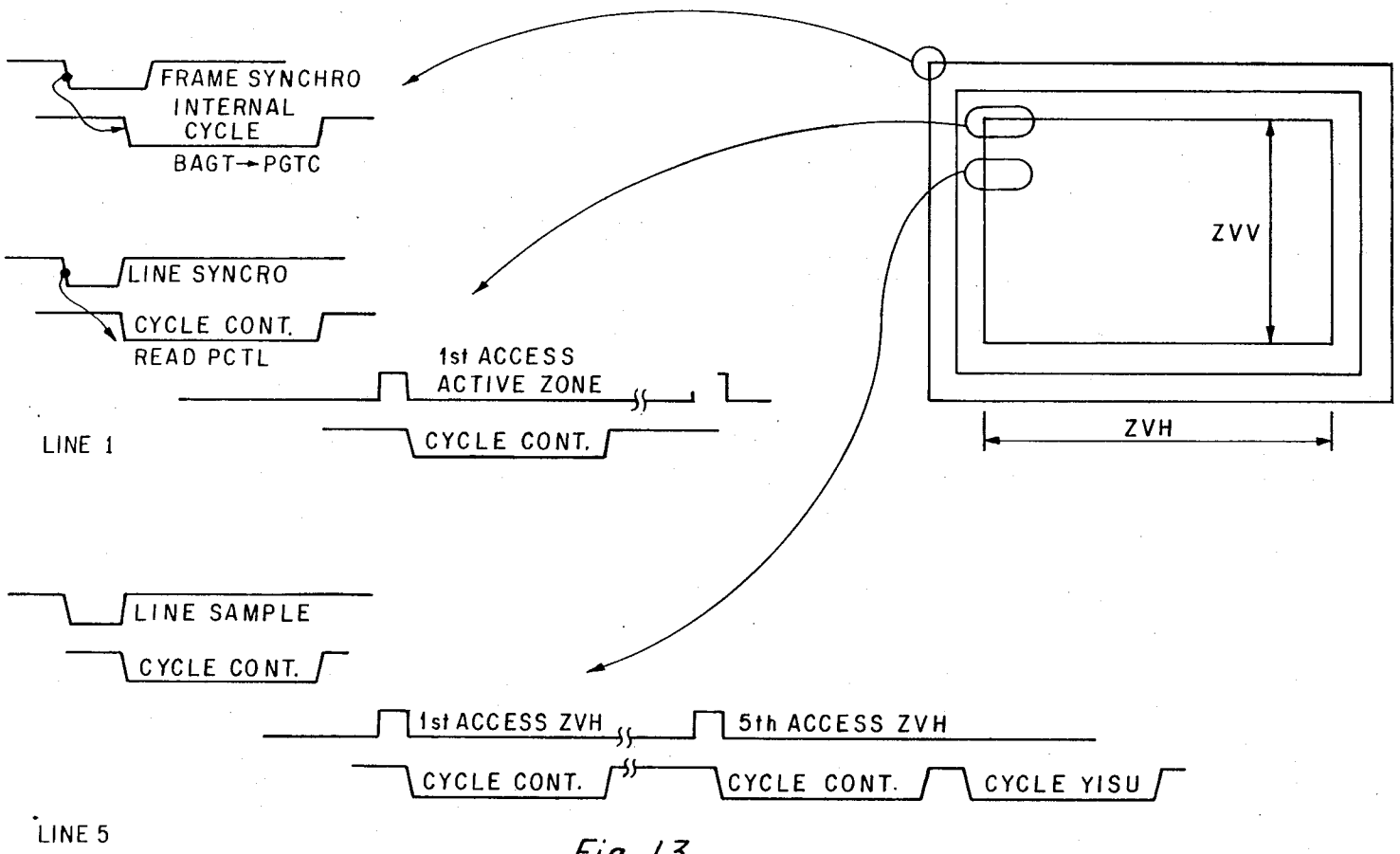
FIG. 13 is a time diagram illustrating the signals for displaying the frame of FIG. 9.
Figure 14A:
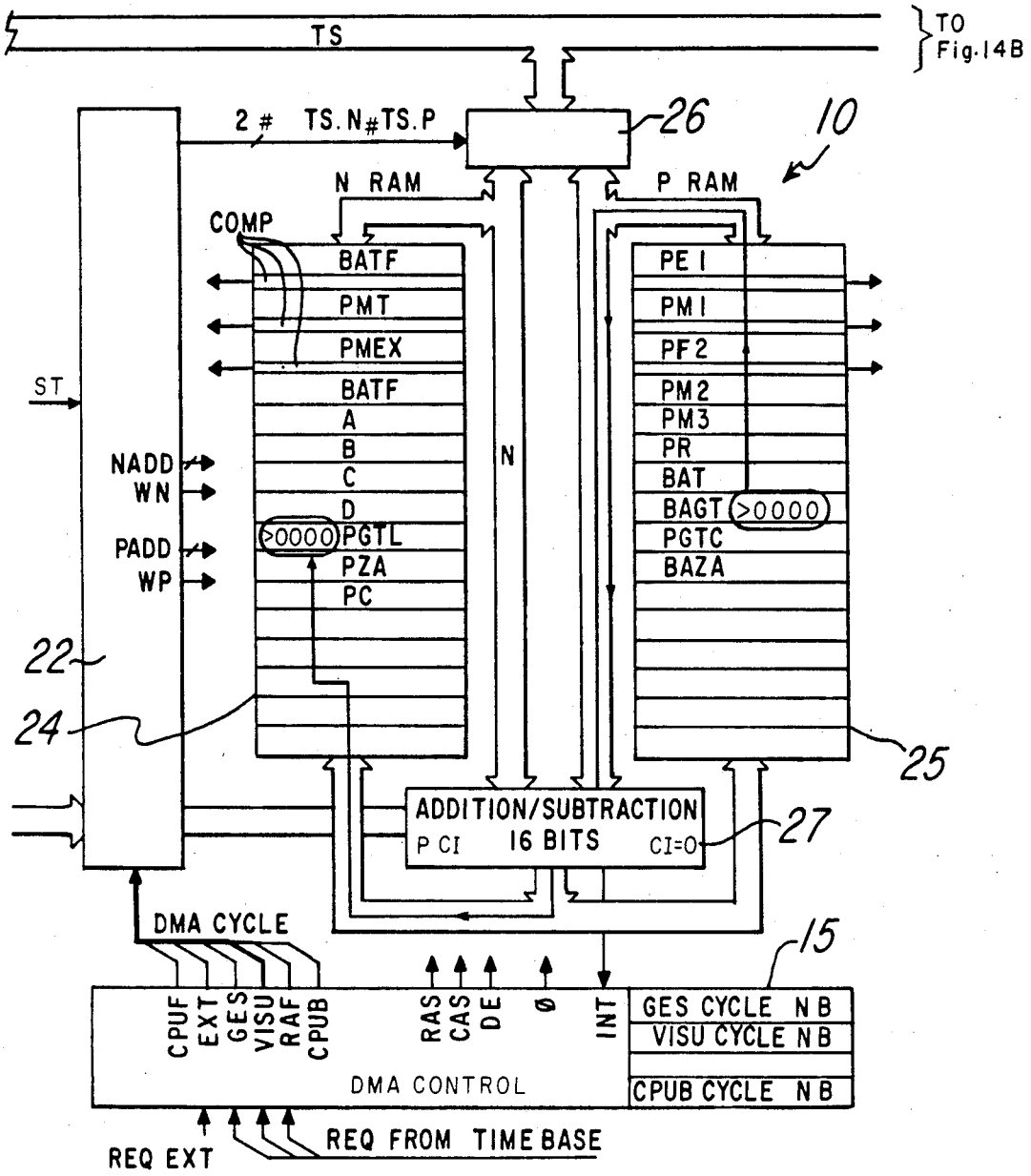
FIG. 14 represents a part of the system illustrated in FIG. 2*b*, as well as the information movement for initializing the pointer of the line control memory.
Figure 14B:
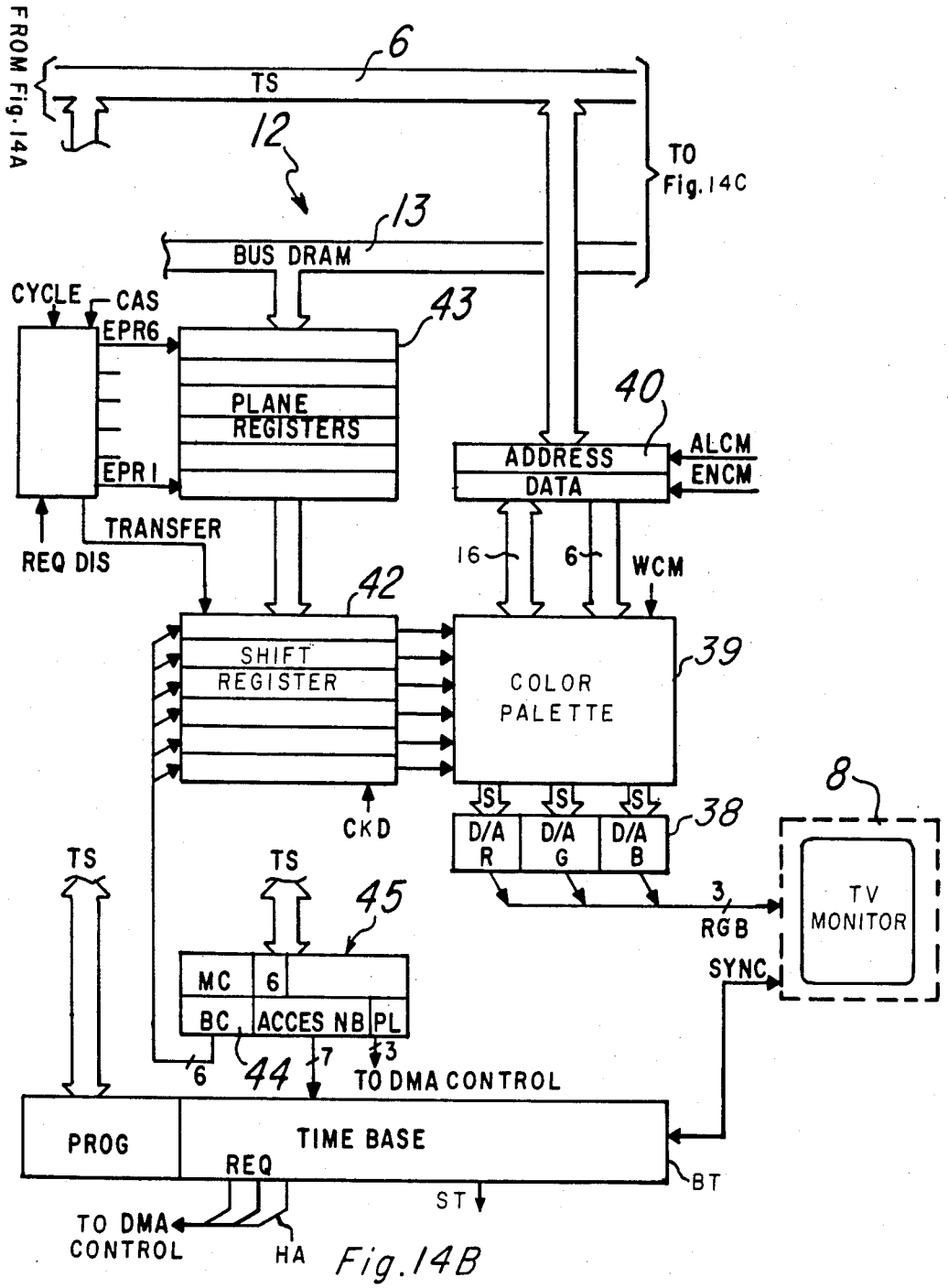
Figure 14C:
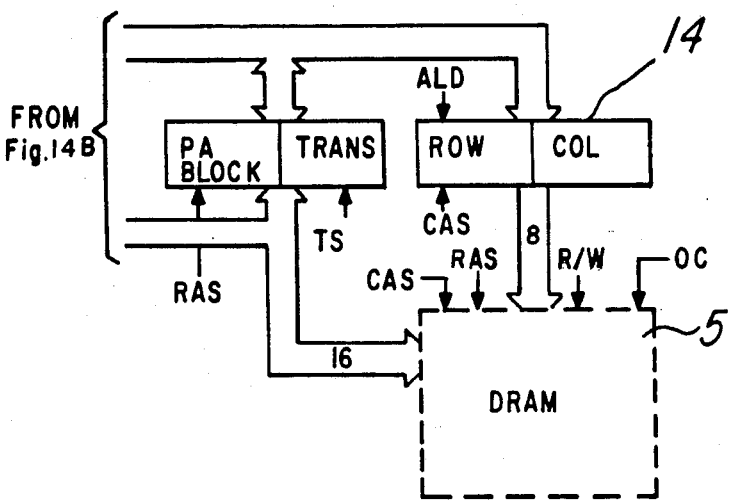

At the frame beginning, the pointer PGTL of line control memory MGL must be initialized by base address BAGT (FIGS. 13 and 14). The access clock of the time base circuit BT starts during the frame synchronization signal ST and the internal cycle "DMA cycle" which transfers the base address "BAGT" in the pointer PGTL of the line control memory. The following accesses relating to the display are triggered during the vertical visualization zone ZVV.

Figure 15A:
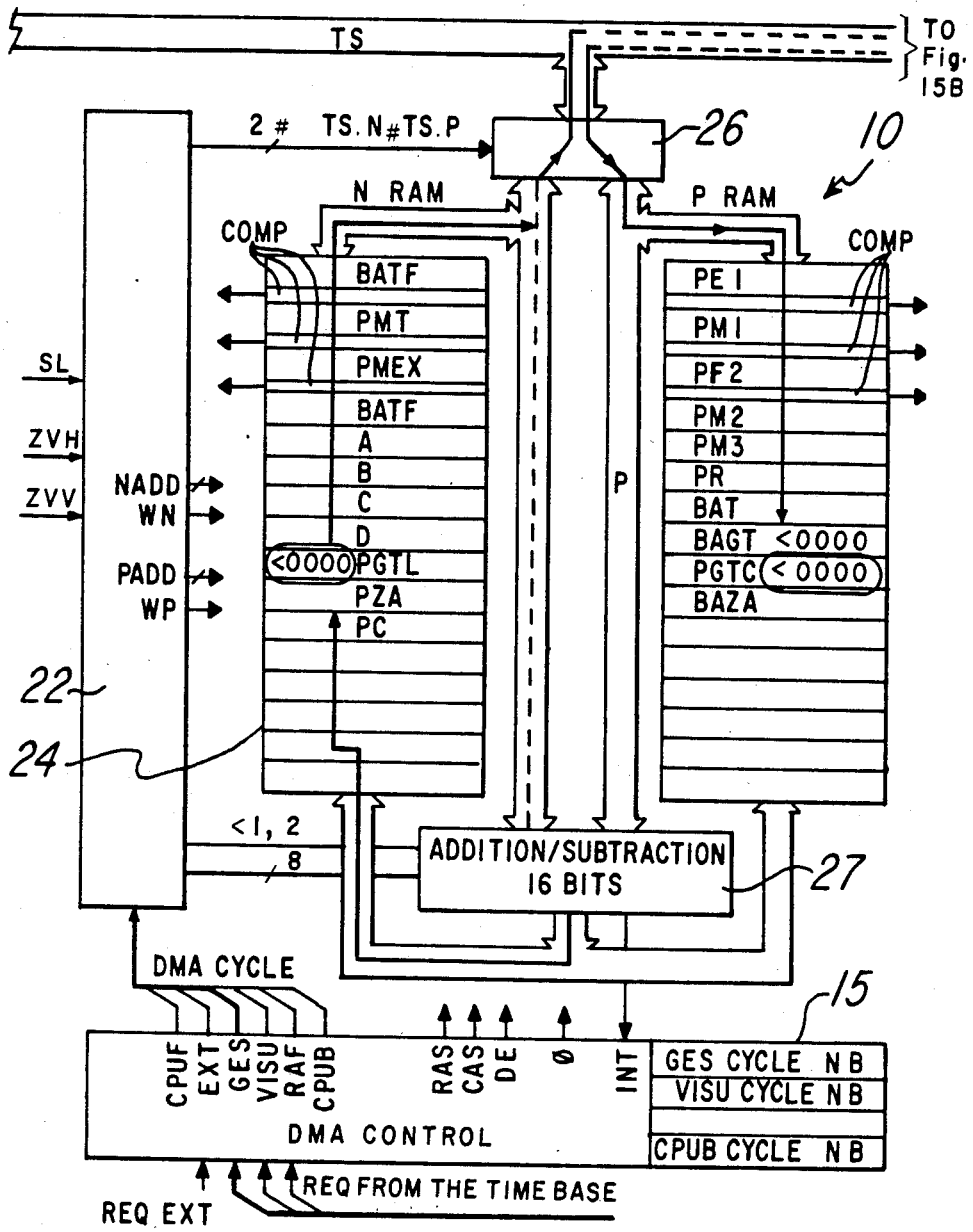
FIG. 15 is a schematic analogous to that of FIG. 14, but representing the access to the line control memory.
Figure 15B:
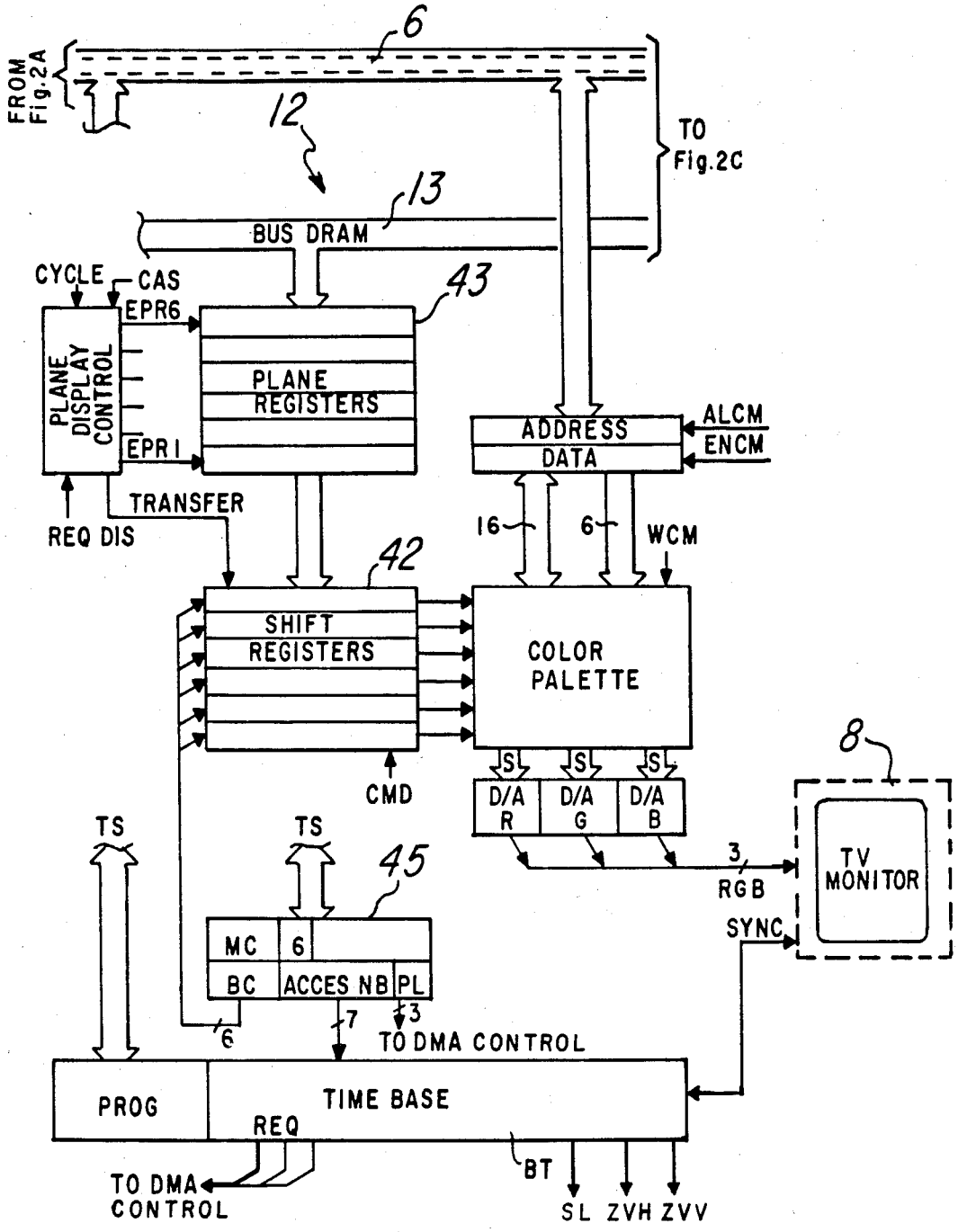
Figure 15C:
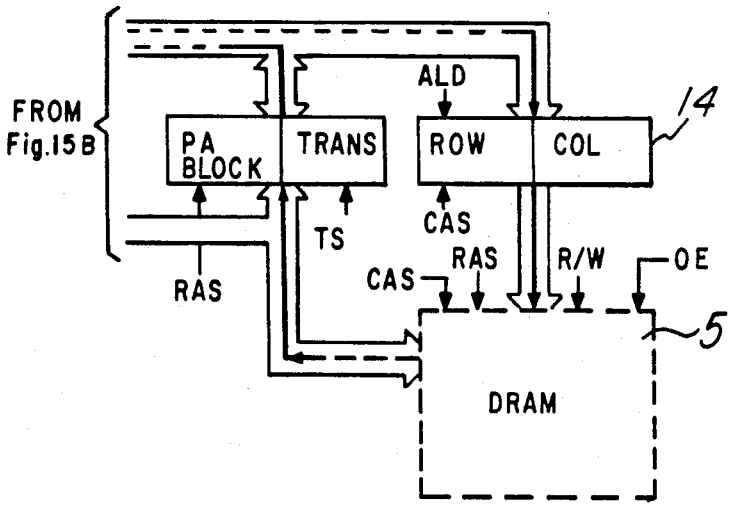
Figure 16:
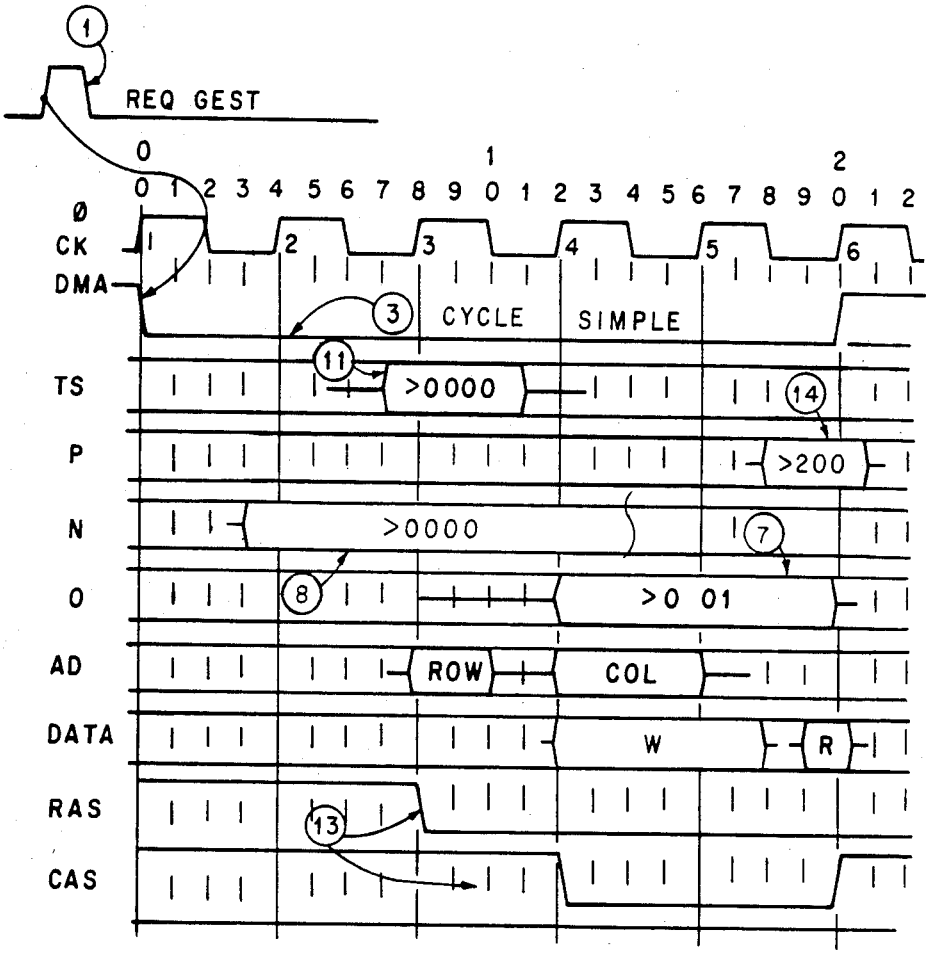
FIG. 16 is a time diagram of the operations illustrated in FIG. 15.

The display starts with region 1 of four lines defined in a uniform color C1. During the line synchronization signal SL (FIGS. 15 and 16) of the vertical display zone "ZVV", the access request "REQ GEST" triggers an access cycle to the line control memory. The address >0000 contained in pointer PGTL selected by "NADD" is transferred on bus 6 for loading into interface 14 of the DRAM. During the same period, it is incremented and then reloaded into pointer PGTL.

These signals "RAS" and "CAS" start the reading at this address >0000. The read value >0200 is loaded into pointer PGTC via data bus 13 and bus 6.

Once it is initialized, the column control pointer PGTC points to the first word of the column control memory from which are extracted the visualization attributes and the address of the zone to be displayed corresponding to the first line displayed on the active zone. This operation is executed from the first access of the horizontal visualization zone ZVH (FIG. 13).

Figure 17A:
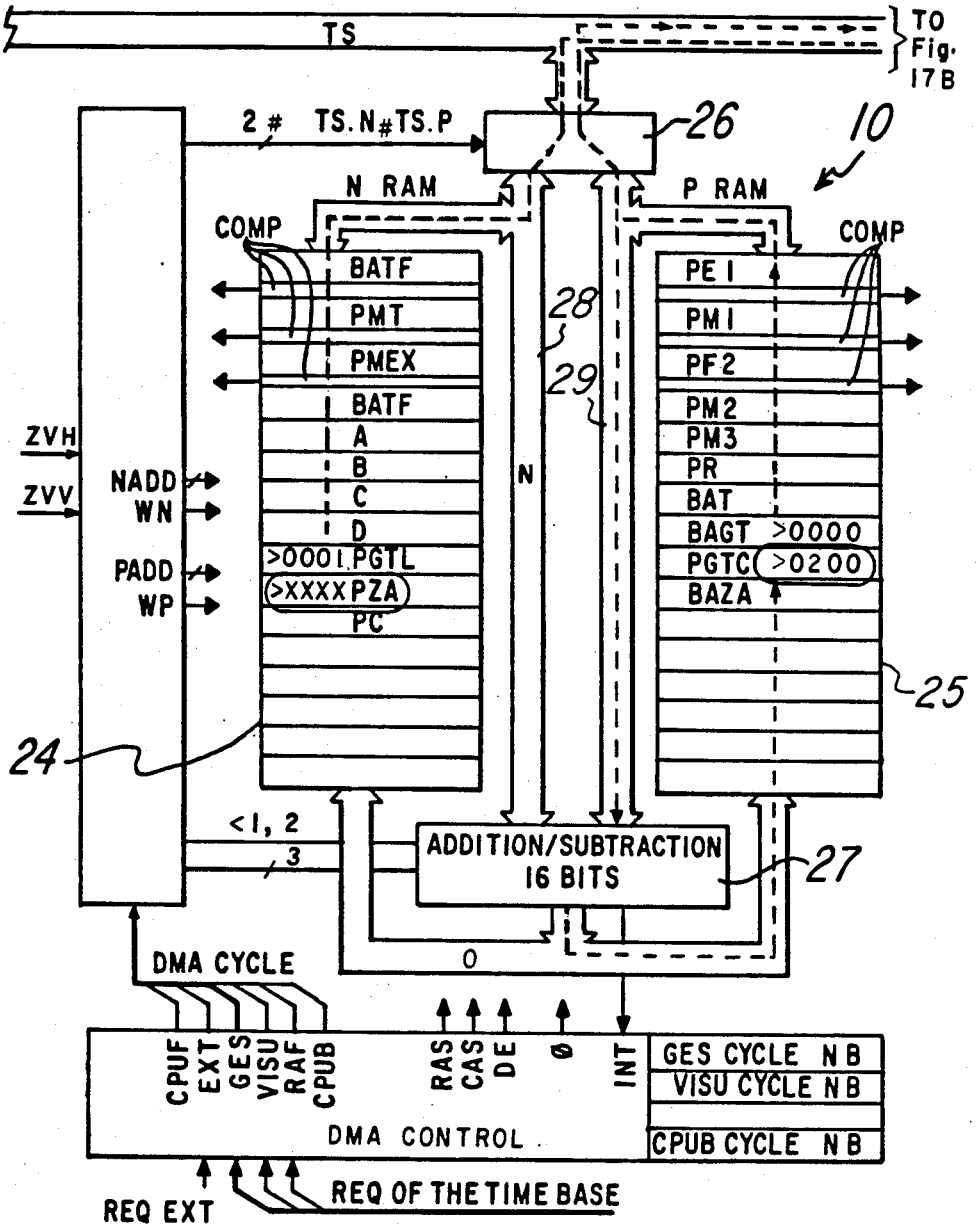
FIG. 17 is a schematic analogous to that of FIG. 14, but representing the access to the column control memory.
Figure 17B:
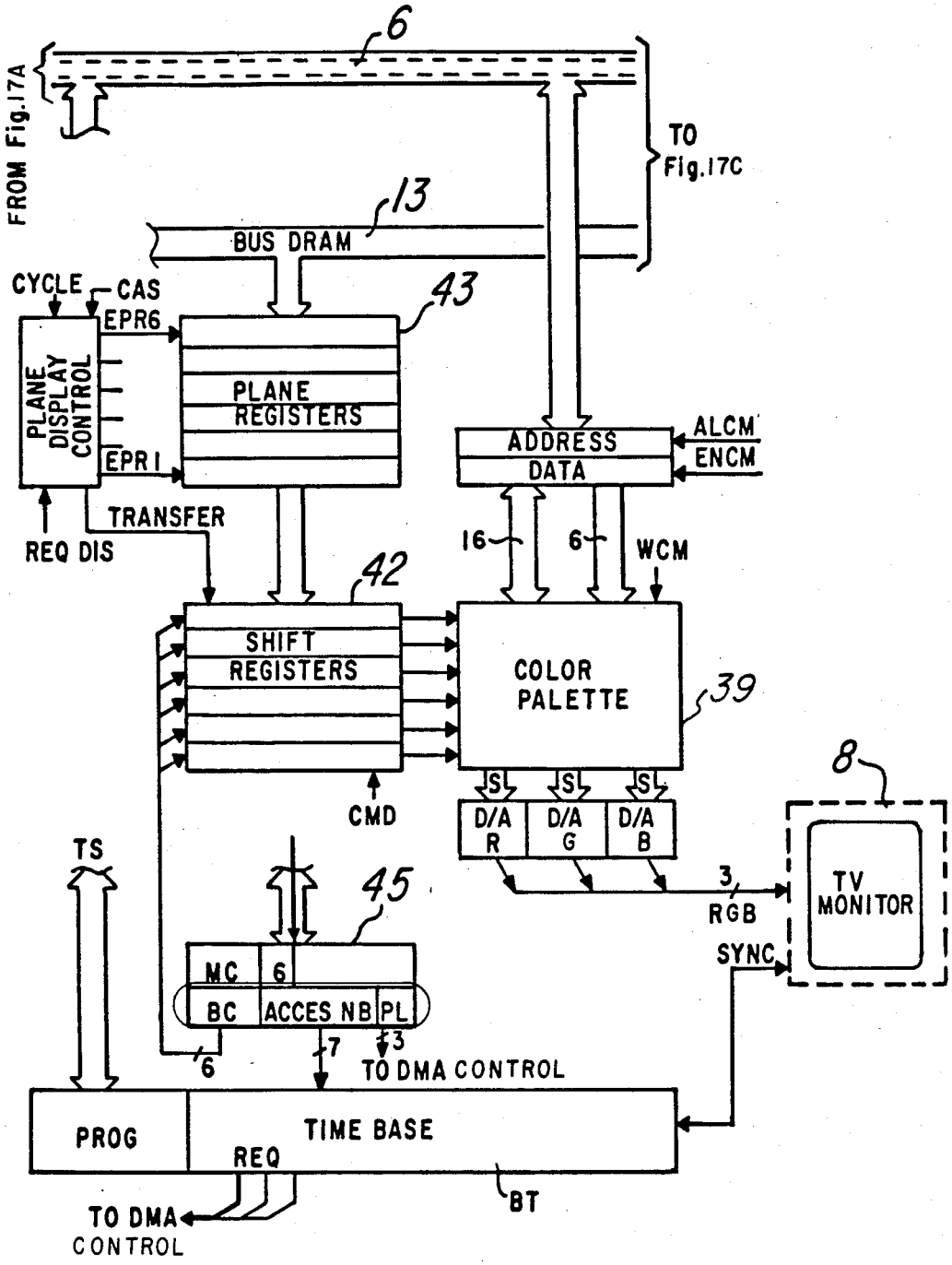
Figure 17C:
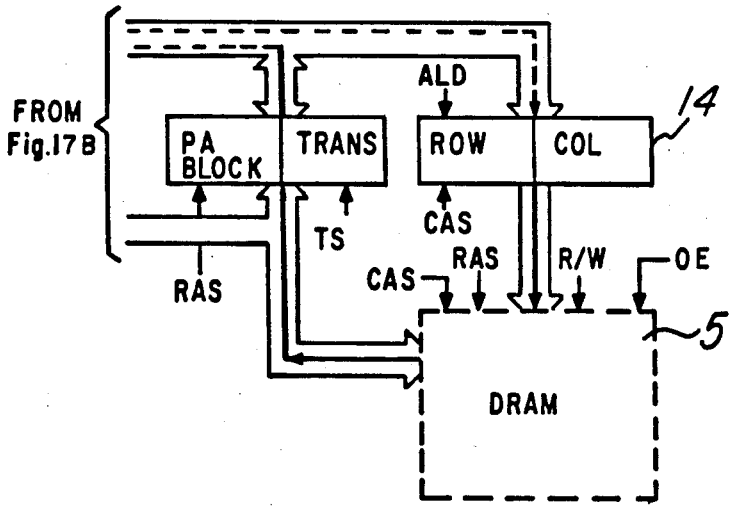
Figure 18:
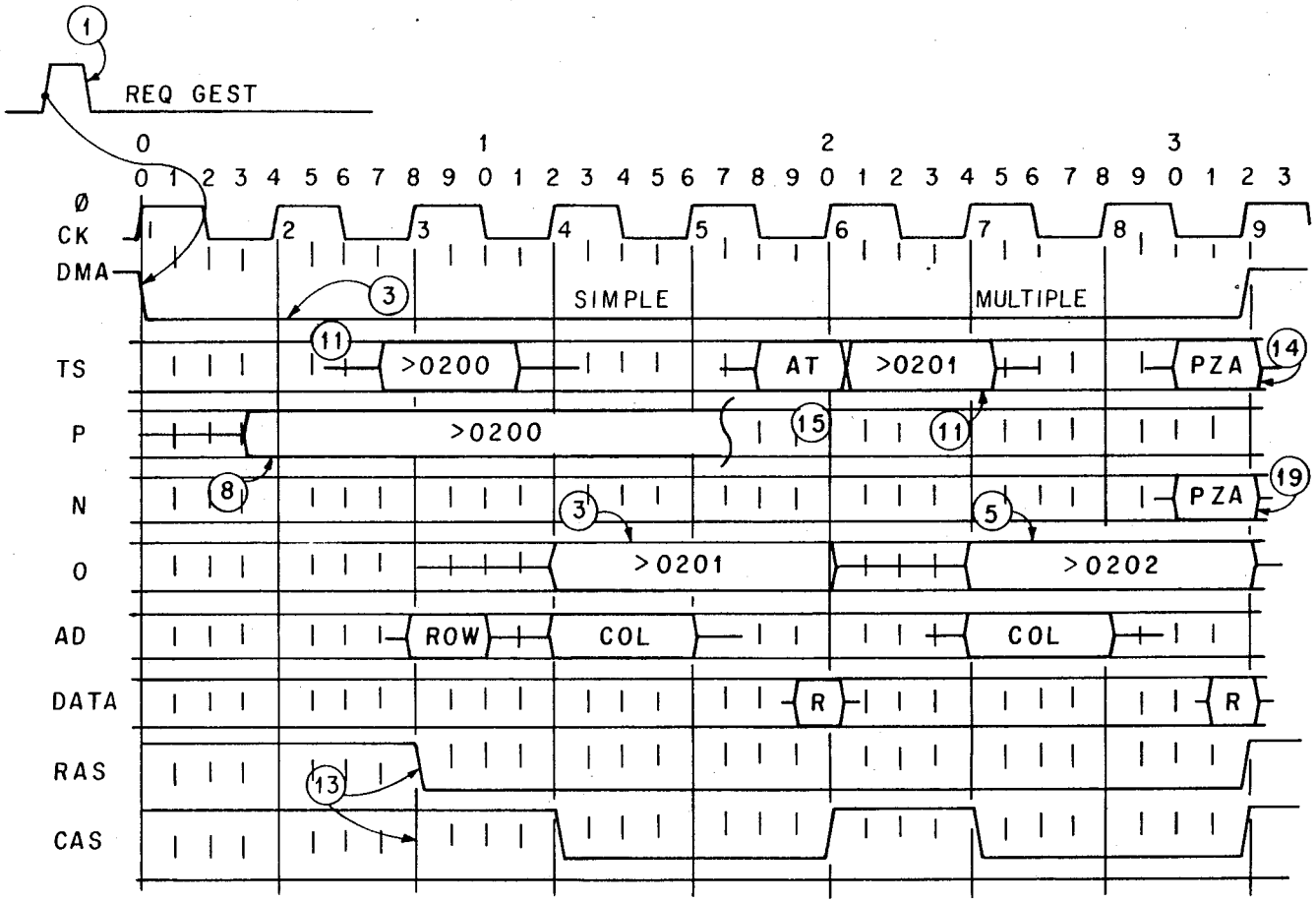
FIG. 18 is a time diagram illustrating the operations effected in the schematic of FIG. 17.

The first access request REQ GEST (FIGS. 17 and 18) is generated by time base circuit BT at the start of the horizontal visualization zone ZVH. It starts, by means of DMA 15, a control access utilizing pointer PGTC previously loaded with the value >0200. This access to the column control memory is effected in two cycles, this number being pre-programmed in the attribute register and transferred each GEST cycle into the counter GES CYCLE NG of DMA 15. Each of the two words read is pointed by the value contained in register PGTC.

During each read cycle, the contents of pointer PGTC selected by address PADD of memory CROM 22 are, on the one hand, transmitted on bus 6 for loading into address multiplexer 14 of memory 5 (loading signal ALD) and, on the other hand, transferred over bus P29 for incrementing in adder 27 and are reloaded into pointer PGTC. The first word read is transferred to attribute register 45 via data bus 13 and bus 6. The second word initializes the pointer of the displayed zone PZA selected in stack N 28 by address NADD from CROM 22.

Referring to FIG. 12, it is seen that the attribute of address >200 ATZ1 defines a base color C1 of palette 39, 32 accesses before the first reading of the control memory, that is to say, the complete line, and the number of display planes (0).

It is noted that in regard to lines 1 to 4 of the screen, the location PZA of the column control memory is not utilized, as no zone memory is used for the display of these lines.

At the start of line 5, the line control pointer PGTL is equal to >0004. According to the same process, its contents are transferred to pointer PGTC, and are utilized for the first access to the column control memory of this line. The address >202 has two definitions corresponding to two zones of the line, namely, a color margin C1 of 5×16 points and a text zone defined on a plane of 27×16 points.

The attribute ATZ2 and the address are extracted from the column control memory following the method described above.

The attribute ATZ2 determines a base color C1 of palette 39 five accesses before the first reading of the column control memory and a number of display planes 0.

During this region, the four accesses do not generate cycle VISU as no memory plane is attributed. The color C1 appears on the screen. At the fifth access, the time base BT generates a new request REQ GEST which extracts from the column control memory the second attribute controlling the line and address of the display zone.

The attribute ATTEX (FIG. 12) defines a base color for palette 39, 27 accesses before the next reading of the column control memory, that is, the rest of the line and a number of planes equal to 1.

The value of PZA >7000 transferred to address processor 10 during the second access GEST is used in the VISU cycle which is started immediately after the access in progress. The cycle VISU extracts from the zone memory, at address >7000, the 16 points defining, in a single plane, the start of the text zone.

The principle used for lines 25 to 80 is identical to that which has been described for regions 2, 3, and 4. These accesses to the column control memory are started, from which there are extracted the characteristics of the different zones, namely: a zone of base color C1 without access to a memory of the display zone, a zone defined on three planes, during eight accesses to the display zone memory where the apple is described, another zone identical to the first, a zone defined on six planes, during eight accesses to the display zone memory where the strawberry is described.

The inventive system, due to its having a column control memory, also allows the display of typographic information and the easy mixing in the same frame of graphical and typographical information, it being understood that the system easily accomodates all of the typographic display norms currently in use. (Standards ANTIOPE, CEEFAX, CAPTAIN, BILDSCHIRMTEXT, etc.)

This aspect of the invention will now be described in detail.

Figures 19A, 19B:
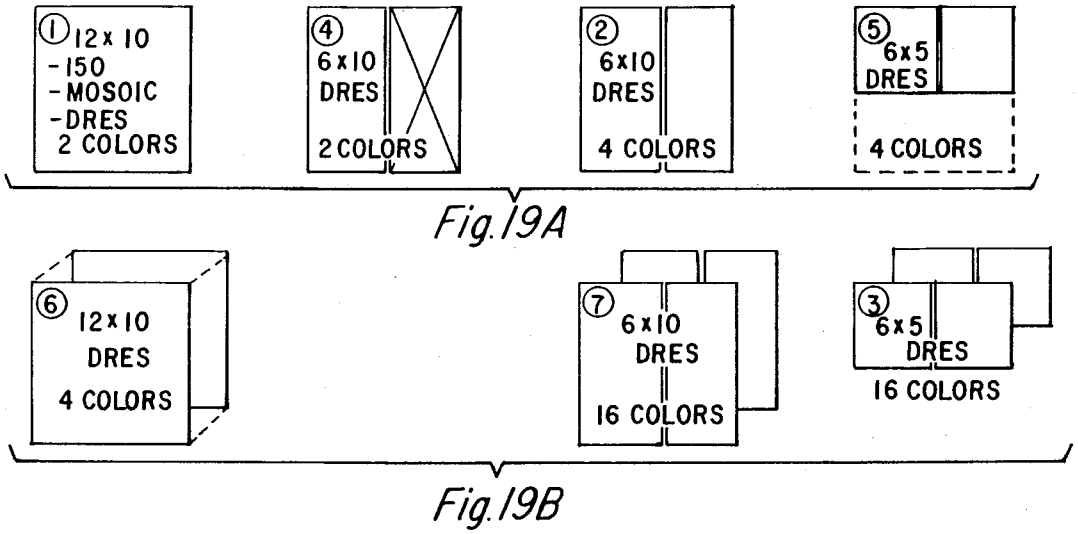
FIG. 19 is a resumé of the display possibilities in the typographic mode of the system as a function of various norms.

It is known that in the typographic mode, there are generally utilized character matrices which, according to the above mentioned norms, can be distributed according to the following table (see also FIG. 19).

| No | Matrix(points) | Colors | Possible Characters |
|---|---|---|---|
| 1 | 12 × 10 | 2 | 94 |
| 2 | 6 × 10 | 4 | 94 |
| 3 | 6 × 5 | 16 | 94 |
| 4 | 6 × 10 | 2 | 94 |
| 5 | 6 × 5 | 4 | 94 |
| 6 | 12 × 10 | 4 | 47 |
| 7 | 6 × 10 | 16 | 47 |

FIG. 19 shows that one can regroup the matrices into two categories A and B, some of them being of the type DRGS (dynamically redefinable character set).

Figure 20:
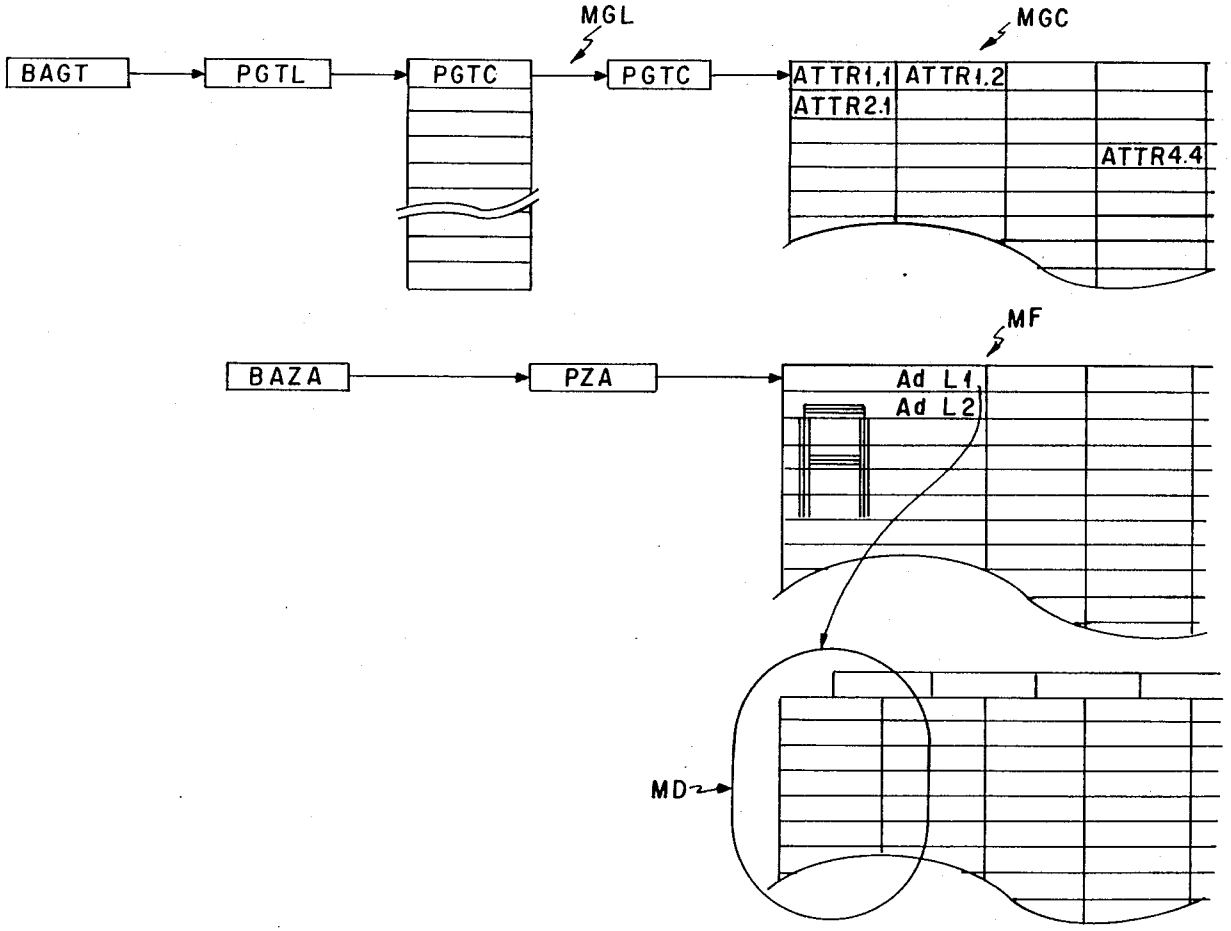
FIG. 20 shows the organization of the memories needed for display in a typographic mode.

To display the matrices, it is necessary to utilize a part of DRAM 5 as a form memory MF (FIG. 20) in which are defined all of the matrices utilized in the system. According to the number of colors with which the characters are to be represented, one uses either the form memory alone (two colors with bits set at "1" or at "0") or this form memory associated with a memory DRCS which defines the colors or the points of the matrix in a plurality of planes (memory MD of FIG. 20).

In category A, all of the matrices can be defined in the memory MF:

Matrix 1. The points are directly interpreted and associated with a background color and a form color, the background color being determined by register 44 (FIG. 2*b*).

Matrix 4. During the writing of the form memory MF, the points are doubled horizontally to obtain a matrix of 12×10.

Matrix 2. The six points of each line of the matrix are defined by two bits for selecting four colors.

Matrix 5-refers to the preceding case but the lines are doubled to include the motif in the width of the matrix.

On the other hand, the matrices of category B cannot be processed with only the form memory because each point is defined by more than two information elements which cannot be translated by a single two state bit.

Consequently, in this case, each matrix is defined in a plurality of zones of the DRAM memory, namely, in the form memory for character configuration and, in regard to colors, in the column control memory MGC in which are memorized the attributes. The display of the characters of category B requires therefore a plurality of consecutive line accesses to DRAM memory 5.

Figure 21A:
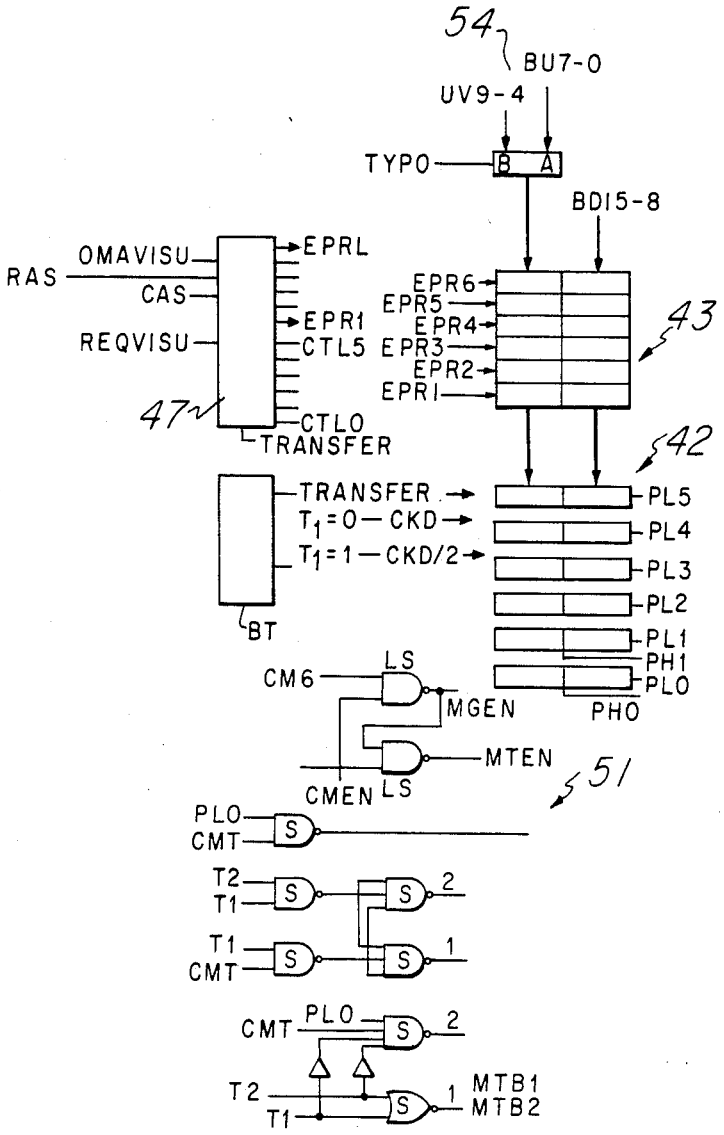
FIG. 21 is a detailed schematic of the display processor of the system.
Figure 21B:
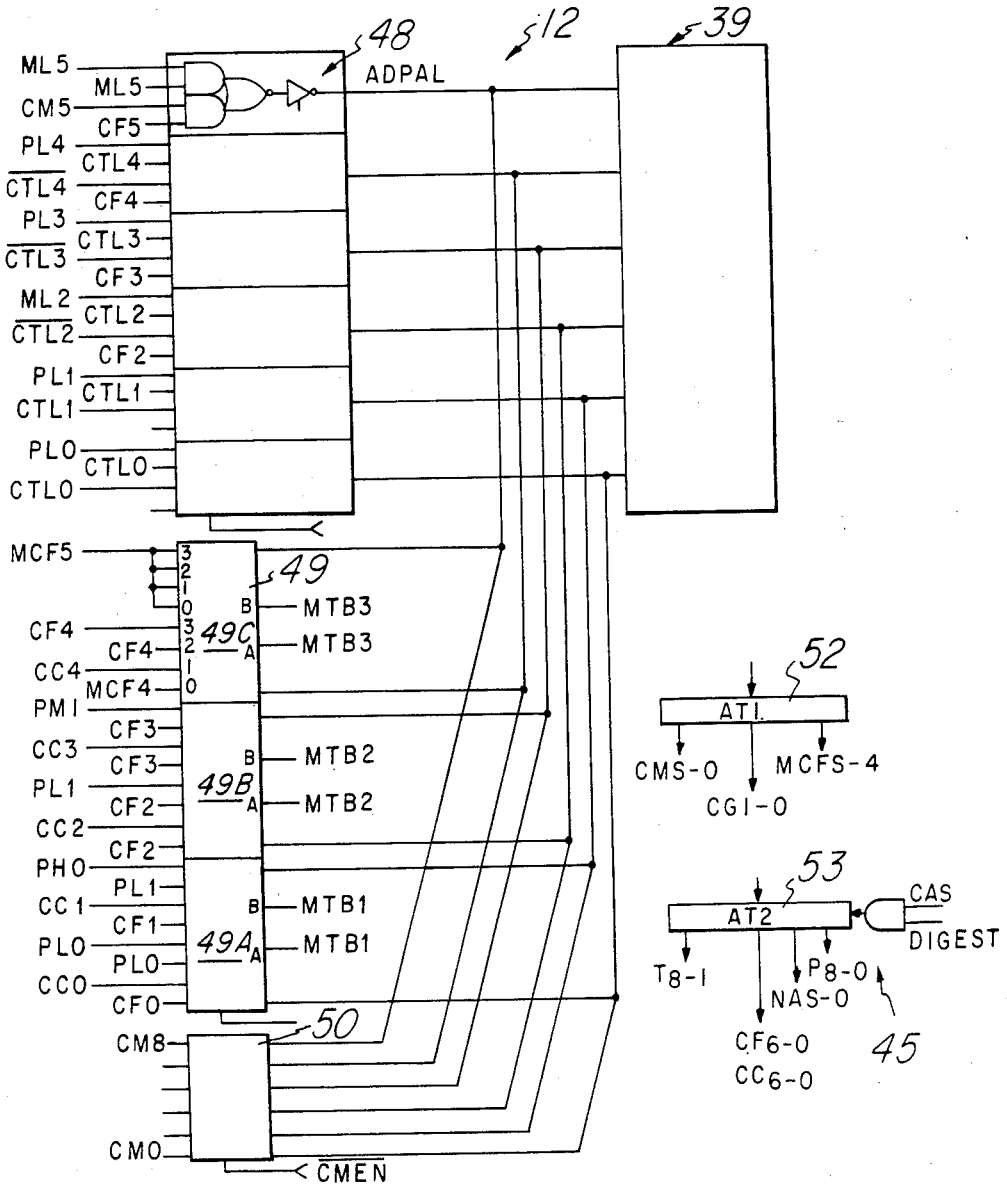

There will now be described FIG. 21 in which there is represented in detail a schematic of the display processor 12 for processing graphical and typographical information.

FIG. 2*b* shows that the display processor includes a set of registers 43 for memorizing the information of the memory plane. They are loaded with 16 bit words, according to the number of planes to be displayed, under control of logical unit 47. The plane registers 43 are connected to shift registers 42 which are loaded when there appears the signal TRANSFERT generated by the control unit 47 in synchronism with the signal REQ VISU from DMA 15.

In the example, there is described the display of six color planes as a maximum, and there are thus 6 plane registers 43 and 6 shift registers 42.

The shift registers 42 are connected to three multiplexors 48, 49, and 50 for processing the addresses of memory palette 39 as a function of the display mode in progress. The multiplexor 48 is used in a graphical mode (as described above), the multiplexor 49 in a typographical mode, and mutliplexor 50 effects the display of the margin color.

The outputs ADPAL 0 and ADPAL 5 of multiplexors 48, 49, and 50 provide selectively the addresses of the 64 color codes memorized in palette memory 39. The multiplexors 48, 49, and 50 are enabled respectively by signals MGEN, MTEN, and CMEN processed in control logical unit 51.

Attribute memorization unit 45 includes two attribute registers 52 and 53 connected to time sharing bus 6 and providing, in regard to register 52, a margin color code by outputs CM5 to CM0, a number bit CGE1-0 representing the number of accesses per cycle to control memory MG, and bits MCF 5 and MCF 4 for determining the base color of palette memory 39.

Register 53, also connected to bus 6, provides outputs T1 and T2 for typographic display, the bits CF5 to CF0 determining the background color of the frame and a plane number code represented by bits P2 to P0.

Register stack 43 is connected to buffer 54 in regard to its eight least significant bits and directly to DRAM bus 13 in regard to its most significant bits. Buffer 54 is also connected to DRAM bus 13 and can be loaded specifically for display in the typographic mode.

Logical unit 51 is connected to control register 20 (FIG. 2*a*) of interface 7 for determining the graphical or typographical display mode. This register provides signals CMG and CMT, the truth table of which is as follows:

Truth Table I

| Mode | CMG | CMT |
|---|---|---|
| Graphical | 1 | 0 |
| Typogr. 8 bits | 0 | 0 |
| Typogr. 12 bits | 0 | 1 |

Operation in the graphical mode is as follows.

Before the display of a line margin, time base circuit BT generates signal CMEN=0, which enables multiplexor 50 to provide color and margin addresses to palette memory 39. Multiplexors 48 and 49 are at high impedance during the margin display.

Besides the margin, signal CMEN=1 and signal CMG=0 so that MGEN=0. This signal enables multiplexor 48 for the graphical display.

After processing the information of each group of 16 points on the screen, that is, each time that the signal REQ VISU appears, the signal TRANSFERT loads the contents of plane register 43 into shift registers 42.

Between two REQ VISU requests, cycle DMA VISU processed in DMA 15, as well as control signals RAS and CAS of the DRAM memory, generate signals ETR1 to EPR6 of control unit 47 in the following manner:

The first access of the request REQ VISU (which, it is recalled, can have up to 6 in the example) generates signal EPR1 and the 16 bits of the word extracted from the memory are loaded into the first register of stack 43. The signal CTL0 is set at "1" to enable the first cell of multiplexor 48.

The second access to the DRAM memory generates signal EPR2 and signal CTL1 is set at 1 while CTL0 remains at 1.

In these conditions, the two first cells of multiplexor 48 are enabled.

The following accesses are processed in the same manner and as a function of the number of planes of the image zone to be displayed; the registers of stack 43 are therefore loaded and the cells of multiplexor 48 enabled by signals CTL0 to CTL5.

Each signal TRANSFERT loads the contents of registers 43 into the respective registers of stack 42, the contents of which being shifted at the rate of signal CKD (point clock) from time base circuit BT.

Each cell of multiplexor 48 includes an input PL5 to PL0 and an input CF5 to CF0 and, according to the presence of one of these signals, the image information is converted into a five bit address of palette memory 39.

For example, if four planes are used for the display, signals CTL0, 1, 2, and 3 are set at "1" and signals CTL4 and 5 are at "0". The outputs PL0 to PL3 are selected to determine the address of palette memory 39 by outputs ADPAL0 to ADPAL3 of the cells of multiplexor 48. Signals CTL4 and 5 being at 0, their complement CTL4 and CTL5 select bits ADPAL4 and 5 of the address of the palette memory by bits CF4 and CF5, the bits CF of the base color being from register 53 loaded by a "control" cycle from column control memory MGC.

As indicated above, the typographic mode contemplates a plurality of display cases depending on the norms used. These cases are fixed by signals CMG and CMT according to truth table I above, and also as a function of signals T1 and T2 according to the following truth table.

Truth Table II

| Case | T1 | T2 | Matrix Points |
|---|---|---|---|
| CAR ISO, DCRS2 colors | 0 | 0 | 12 × 10 |
| DCRS 4 colors | 0 | 1 | 12 × 10 |
| DCRS 4 colors | 1 | 0 | 6 × 10 |
| DCRS 16 colors | 1 | 1 | 6 × 10 |

Signals CMG and CMT determine if the display is effected with matrices of eight or twelve points per line.

Signals CMG, CMT, T1 and T2 are applied to logic unit 51 in which they control the establishment of signals which are applied to multiplexor 49 in the typographic mode. When signals T1, T2, and CMT are at "0", signals MTA3, MTBA1, MTB2, and MTB3 are also at "0", signals MTA1 and MTA2 have the value of signal PL0 which is the output of the last shift register of stack 42.

In part 49*c* of multiplexor 49, signals MTA3 and MTB3, set at 0, select paths 0 so that signals MCF4 and MCF5, which were previously loaded into attribute register 52, will be applied as base addresses to inputs ADPAL4 and ADPAL5 of palette 39.

In parts 49*b* and 49*c* of multiplexor 49, signals MTB1 and MTB2 are at 0 and signals MTA1 and MTA2 have the polarity of signal PL0.

Each "1" bit of this signal selects the character color of the matrix (CC0 to CC3) constituting the address of the palette on inputs ADPAL0 to ADPAL3. Each "0" bit selects the background color (CF0 to CF3).

Figure 22:
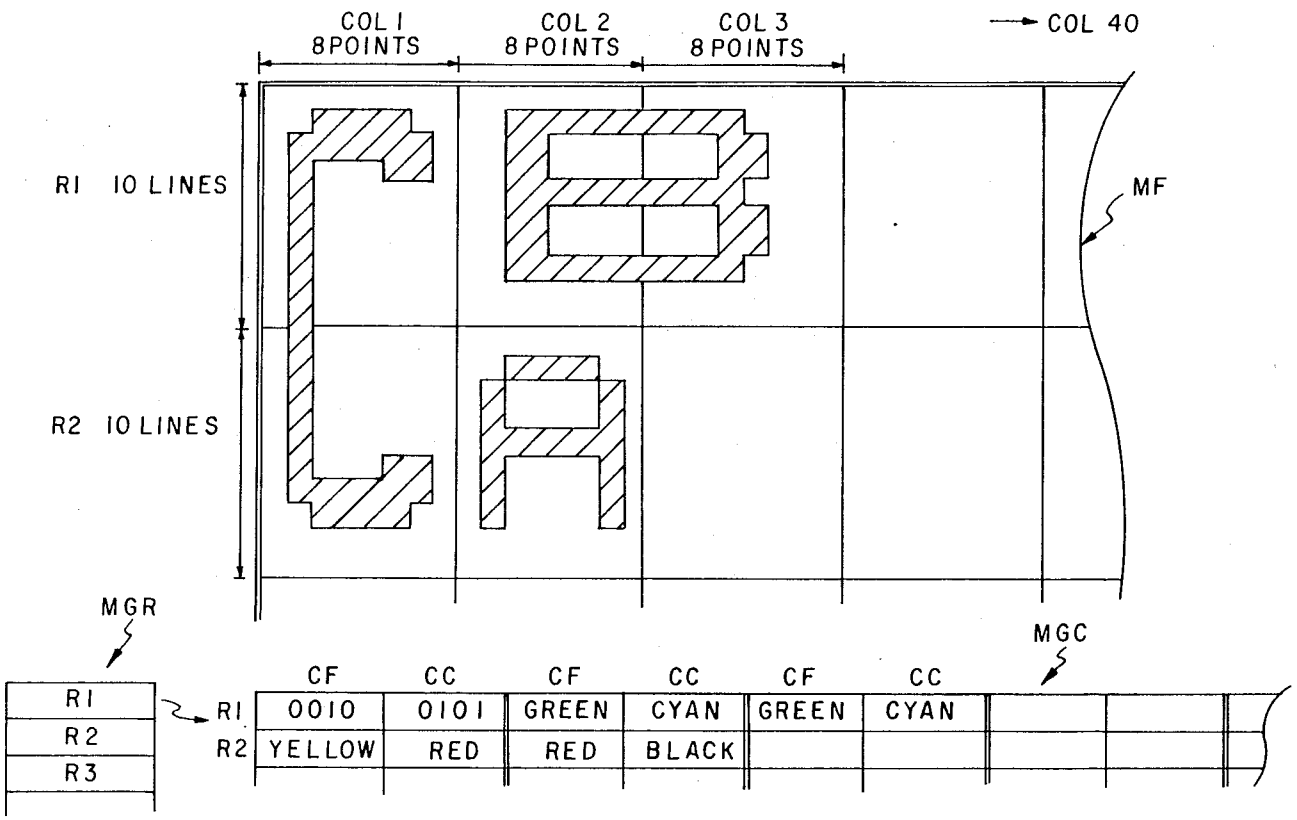
FIG. 22 illustrates the operation of the display processor for the display of character matrices with eight image points per line.

FIG. 22 represents schematically the manner in which the control memory produces the contents of attribute register 53 in the case of an eight bit display. During each access REQ VISU, register 53 is loaded by the contents of the corresponding cell of column control memory MGC, which contains the four bits CC0 to CC3 of the character color, and the four bits to CF0 to CF3 of the background color.

Only the last registers of stacks 42 and 43 are utilized for transforming the information contained in form memory MF.

When the twelve bits per line matrices are to be displayed, signal CMP is placed at "1" and signal CMG at "0".

Figure 23:
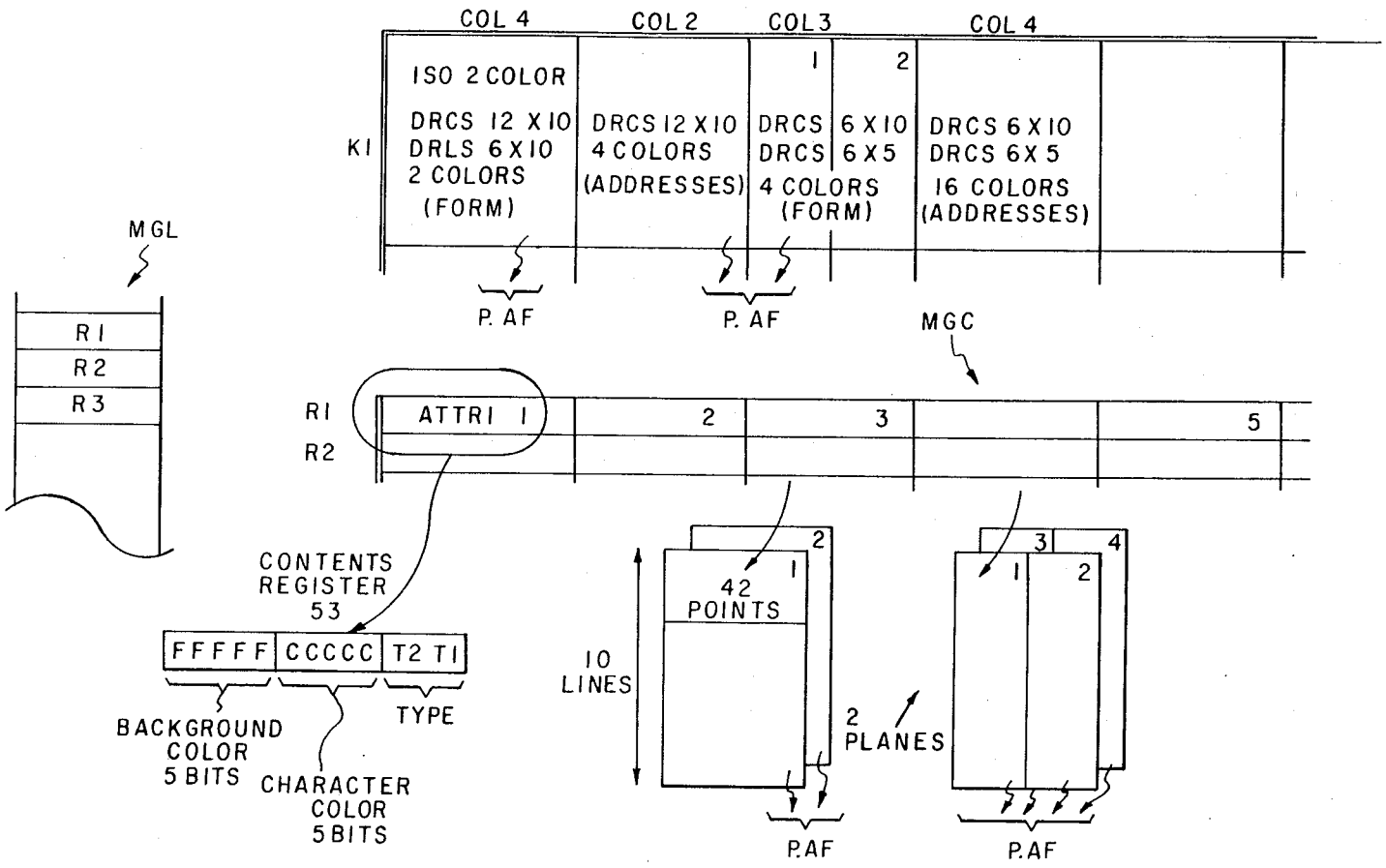
FIG. 23 illustrates the operation of the display processor for the display of character matrices with twelve image points per line.

FIG. 23 shows the display of some characters having different formats.

The first matrix concerns a character ISO or DRCS of 12×10 points.

| | |
|---|---|
| T1 and T2 = 0 | MTB1 = 0 and MTB2 = 0 |
| CMT1 = 0 | MTA3 = 1 |

These signals MTA2, MTA1, and MTB3 have the polarity of signal PL0 by means of gate 55 of logical unit 51.

| | |
|---|---|
| If PLO = 0 | MTB1 = 0, MTB2 = 0, MTB3 = 1 |
| | MTA2 = 0, MTA1 = 0, MTB3 = 1 |
| If PLO = 1 | MTB1 = 0, MTB2 = 0, MTA3 = 1 |
| MTA2 = 1, MTA1 = 1, MTB3 = 0. | |

In the first case, the signals of the background color CF0 to CF4 cause the application to palette 39 of an address on inputs ADPAL0 to ADPAL4. In the second case, signals CC0 to CC4 generate the address on these same inputs.

The signal MCFS from attribute register 52 selects the base color of palette 39.

The second matrix relates to character DRCS having four colors.

T1=0, T2=1, CMT=1 it results from this:

MTA1=0, MTA2=0, MTA3=1

MTB1=1, MTB2=1, MTB3=1

The signals thus established select in mutliplexor 49.

PL0 and PL1 for part 49*a*

CF2 to CF4 to MCF5 for parts 49*b* and 49*c*.

These latter determine, in palette 39, a base color, and part 49*a* selects, with the two bits PL0 and PL1, a color among four possible colors.

To display this type of character, the column control memory MGC is read at each request REQ VISU and the word READ is loaded into register 53 which contains (FIG. 23) five bits for the background color, five bits for the character color, and bits T1 and T2.

When, as it is the instant case, T2=1, the form memory will not contain the character form itself, but rather an address for a character memory (not shown) provided in another zone of DRAM 5.

At the time of the first cycle DMA VISU following signal REQ VISU, the contents of the cell of the form memory MF addressed by pointer PZA of address processor 10 are transferred to the address processor due to a microcode determined by signal T2 in memory CROM 22. Two accesses of the DRAM memory are then sequenced one after the other by address processor 10 to extract from the character memory two words of twelve bits corresonding to the color of the points of matrix DRCS. The two words are transferred into the two first registers of stack 43 (FIG. 21) and the contents of these registers are loaded into two registers of stack 42 during the following access. The information of these registers is then extracted by shifting at the point clock rate to obtain signals PL0 and PL1 applied to part 49*a* of multiplexor 49.

The third matrix contains a four color character at half resolution. (Only six points per line.) This resolution is determined by the state of bit T1 (at an up level). In these conditions, the shift registers of stack 42 receive shift signals at half of the point clock frequency (CKD).

T1=1 and T2=0, it results from this:

MTA=1, MTA2=0, MTA3=1

MTB=1, MTB2=1, MTB3=1.

From this, multiplexor 49 determines PL0 and PH0 for the address ADPAL0 and ADPA1, CF2, CF3, CF4, and MCF5 for addresses ADPAL 2 to ADPAL 5.

This four color address is obtained by successively loading a word of twelve bits from form memory MF into the plane register of stack 43 selcted by signal EPR1. During the following access, this word is transferred to the shift register corresponding to stack 42 to generate signals PL0 and PH0.

From this, stack registers 42 and 43 are loaded in two parts, bits BD15 to BD10 being placed in the right part of the respective registers while buffer 54 loads bits BD9 to BD4 into the left parts. As PH0 appears at the eighth bit of the shift register and PL0 at the sixteenth, two information elements, PL0 and PH0, shifted at half frequency, select, in palette 39, one color among 4 according to the previously described method.

The fourth matrix contains a character of type DRCS having 16 colors at half resolution.

Bits T1 and T2 select:

MTA1=1, MTA2=1, MTA3=1

MTB1=1, MTB2=1, MTB3=1

The parts 49*a* and 49*b* of the multiplexor select, for PL0, PH0, PL1, and PH1, the address bits ADPAL 0 and ADPAL 1.

Part 49*c* of the multiplexor selects CF4 and MCF5 for the base color of palette 39.

It results from the above that, in a typographic mode as well, the system is very flexible and allows the display of all of the known typographic standards with a minimum memory capacity, In the graphic and typographic display modes, the invention provides for ease in image manipulation, vertical or horizontal, by a simple modification of a frame to another base addresses of the various control memories. It is thus possible to obtain image animation, to load colors, to scroll the image, etc.

We claim:

1. A system for the display of video images on a display screen (8) by line by line and point by point frame sweeping this device comprising:

a composite memory in which are memorized image data to be displayed for each frame, a video display processor (12), connected to said composite memory, for composing the image in conjunction with said composite memory;

a time base means (BT), connected to said video display processor and synchronized with the line by line sweeping;

a control device (15) for dynamic access to the memory for allocating the access times among different units of the system which utilize the memory;

said composite memory comprising;

a first control memory (MGL) for memorizing a data word for each line in the image to be displayed, each word containing an address value relating to its associated line of the image;

a zone memory (MZ) for the memorization of image data relating exclusively to zones of the image in which intelligible information is to be displayed and;

a second control memory (MGC) addressable by address values contained in the first control memory and storing, at a location corresponding to each of the addresses stored in said first control memory, a display attribute word characterizing the contents of the line(s) corresponding to the value of the respective address of the first control memory (MGL) and, for each line containing intelligible information, an address value specifying the location in said zone memory where the intelligible information to be displayed in said line is stored;

wherein a plurality of lines in said image which are characterized by the same display attribute word may have the same address value stored in their associated data words of said first control memory (MGL), so that the same addressable location of said second control memory (MGC) is accessed for each of said plurality of lines.

2. A system according to claim 1 wherein the value of the display attribute stored in the second control memory (MGL) is associated with the value of an address of the start of a zone memory (MZ), in the case where the corresponding line contains intelligible information.

3. A system according to claim 1:

wherein said video display presents video images in a plurality of colors, said colors determined by the values of a multiple number of data bits stored by said zone memory for each point in said line;

and wherein said attribute value (ATTR) contains binary values relating to the color of the line and the number of data bits stored by said zone memory for said points in said line.

4. A system according to claim 3:

wherein the contents of a line of said video image corresponding to the value of the address of the first control memory (MGL) has a plurality of sections, said sections having display attributes different from one another, and each said section having a display attribute data word stored in said second control memory (MGC);

and wherein each said display attribute data word associated with a section of said line also includes a binary value relating to the number of points in said section of said line.

5. A system according to claim 1 wherein said composite memory further comprises:

a form memory (MF), divided into matrices which each contain the form of a typographic character to be displayed;

wherein said display attribute data word contained in said second control memory (MGC) includes binary codes corresponding to a background color and corresponding to the form of the matrix corresponding to the form memory.

6. A system according to claim 5 wherein the form memory (MF) also includes addresses for directly accessing the matrices defined on at least two color planes and stored in said zone memory.

7. A system according to claim 5 wherein the display attribute data word stored in said second memory (MGC) also includes a code representing an address value, and in that said composite memory (5) also includes a third memory (MD), addressable by said address value, and containing, for at least some of the matrices to be displayed, a data word relating to supplementary color codes with which the character of the matrix is to be displayed.

8. A system according to claim 5 wherein said time base (BT) includes a first clock output (CKD) on which appears a clock signal having a frequency equal to the number of points per line of each matrix.

9. A system according to claim 5 wherein, for defining the resolution of the display of character matrices, said display attribute data words stored in said memory include a definition bit, and wherein said time base (BT) includes a second clock output (CKD/2) for providing a clock signal, the frequency of which being half of the signal frequency of the first output of said time base, and wherein the definition bit is utilized for commutating the display clock frequency of the first and second output or, inversely, for the adaption of the display to different character standards.

10. A system according to claim 1 in which said display processor includes a palette memory (39) connected to said screen which has a plurality of codes of colors to be displayed on the screen, a first group of registers (42) of the shifting type controlled in parallel by said time base (BT) at the rate of the sweep frequency of the points of the screen, and contains, in an evolving manner during display, a group of points to be displayed, the binary values of the color constituting the addresses for said palette memory (39), a second group of registers (43) for temporarily memorizing the color information of a group of points to be displayed after that whose information is in said shift registers, and a control unit (47) for periodically controlling the transfer of the information from the second group of registers to the first, wherein said first group of registers (42) is connected to said palette memory by multiplexing means (48,59,50) to control the information contained in this first group of registers as a function of the graphical or typographical display mode to be executed.

11. A system according to claim 10 wherein the video display processor includes in addition attribute storing means (52,53) for receiving the display attribute data words from said second control memory MGC, and wherein there is also provided a control logic unit (51) connected to said attribute storing means (52,53), and to the multiplexing means for placing this latter into the appropriate configuration as a function of the binary values of the attributes memorized at a given moment of the display.

12. A system for visually displaying digital data, said data representative of text and of graphics, comprising:

a video display arranged in lines and columns;

a video display processor, connected to said video display to present said digital data to said video display in a line-by-line format, said video display processor presenting said digital data to said video display in varying numbers of parallel data bits, said video display displaying an image responsive to said parallel data bits of digital data presented thereto;

a memory, connected to and addressable by said video display processor, for storing the digital data to be displayed by said video display;

wherein said memory contains a zone memory for storage of information to be displayed by said video display;

wherein said memory contains, for each line to be displayed by said video display:

a line control data word;

a first data word describing the number of parallel data bits stored for the information to be displayed at a first column in said line, and describing the number of columns in said line following said first column which are described by the same number of parallel data bits as said first column, the location of said first data word in said memory specified by said line control data word; and a second data word describing the location in said zone memory storing the information to be displayed in said columns in said line described by said first data word;

wherein, for a plurality of lines to be displayed which have the same number of parallel data bits and the same information to be displayed in the columns thereof, the line control data words associated with each of the lines of said plurality of lines may have the same contents, thereby accessing the same first data word for each of said lines.

13. The system of claim 12, wherein said memory contains, for each line for which the number of columns in said line following said first column which is similarly text or graphics information is less than the number of columns in the line of the display:

a third data word describing the number of parallel data bits stored for the information to be displayed at a second column in said line, and describing the number of columns in said line following said second column which are described by the same number of parallel data bits as said second column; and a fourth data word describing the location in said zone memory storing the information to be displayed in said columns in said line described by said third data word.

14. The system of claim 12, wherein the number of parallel data bits stored for the information to be displayed corresponds to a plurality of colors displayable by said video display responsive to the values of the parallel data bits.

15. The system of claim 14, wherein the number of colors displayable by said video display is the value of two raised to the power of the number of parallel data bits stored for the information to be displayed.

16. The system of claim 14, wherein said video display processor comprises:

an arithmetic and logic unit;

bus means, connected to said arithmetic and logic unit and said memory, for communicating data between said memory and said video display processor, said data comprising memory addresses presented by said arithmetic and logic unit, and also comprising the contents of the locations in said memory corresponding to said addresses;

a plurality of registers, connected to said bus means, for storing data from said zone memory representative of the information to be displayed on said video display; and a palette memory, having an input connected to said plurality of registers and having an output, for reformatting the digital data stored in said registers into digital color information; and analog-to-digital converter means, having an input connected to the output of said palette memory and having an output connected to said video display, for converting the digital color information presented by said palette memory to an analog format utilizable by said video display.

17. The system of claim 12, wherein said memory further comprises a form memory, said form memory having a plurality of addressable locations, each storing a predetermined form of a text character;

and wherein the locations in said memory at the location specified by said second data word, for such lines which are to display text information, contain addresses of forms in said form memory.

* * * * *